US011785681B2

(12) United States Patent
Banavara

(10) Patent No.: US 11,785,681 B2
(45) Date of Patent: Oct. 10, 2023

(54) TECHNOLOGIES FOR CONTROLLING COOKING APPLIANCES USING SHARED COOKING RECIPES

(71) Applicant: Intel Corporation, Santa Clara, CA (US)

(72) Inventor: Prasanna Ramarao Banavara, Bangalore (IN)

(73) Assignee: Intel Corporation, Santa Clara, CA (US)

( * ) Notice: Subject to any disclaimer, the term of this patent is extended or adjusted under 35 U.S.C. 154(b) by 79 days.

(21) Appl. No.: 17/369,656

(22) Filed: Jul. 7, 2021

(65) Prior Publication Data

US 2021/0410240 A1 Dec. 30, 2021

Related U.S. Application Data

(63) Continuation of application No. 14/752,451, filed on Jun. 26, 2015, now Pat. No. 11,064,579.

(51) Int. Cl.
*H05B 6/64* (2006.01)

(52) U.S. Cl.
CPC ..... *H05B 6/6438* (2013.01)

(58) Field of Classification Search
CPC .. H05B 6/6433; H05B 6/6435; H05B 6/6447; H05B 6/66; H05B 6/668; H05B 6/68; H05B 6/6438; H05B 2213/06; H05B 1/0263; A23L 1/01; A23L 50/10; G05B 19/045; G05B 19/00; G05D 23/30; G09B 1/24

See application file for complete search history.

(56) References Cited

U.S. PATENT DOCUMENTS 4,837,414 A * 6/1989 Edamula ..... H05B 6/6482 235/462.15

8,549,606 B2 10/2013 Saito (Continued)

FOREIGN PATENT DOCUMENTS

WO 2016018000 2/2016

OTHER PUBLICATIONS

United States Patent and Trademark Office, "Requirement for Restriction/Election," issued in connection with U.S. Appl. No. 14/752,451, dated Jan. 27, 2017, 8 pages.

(Continued)

*Primary Examiner* — Shawntina T Fuqua
(74) *Attorney, Agent, or Firm* — HANLEY, FLIGHT & ZIMMERMAN, LLC

(57) ABSTRACT

Technologies for controlling a cooking appliance include receiving a cooking recipe from a computing device. The cooking recipe defines one or more cooking steps and each cooking step includes executable instructions that are executable by the cooking appliance to cause the cooking appliance to perform the associated cooking step. The cooking appliance may execute the instructions of each cooking step to perform the cooking recipe. The recipe may include digital rights management features, may be encrypted, and may include additional information such as an ingredient list. The cooking appliance may provide instructions, such as audible instructions, to a user while cooking the recipe. The user may also generate a cooking recipe using the cooking appliance and share the cooking recipe with other users.

20 Claims, 9 Drawing Sheets

(56) References Cited

U.S. PATENT DOCUMENTS

| | | | | |
|---|---|---|---|---|
| 11,064,579 | B2 | 7/2021 | Banavara | |
| 2014/0170275 | A1 | 6/2014 | Bordin | |
| 2015/0074237 | A1* | 3/2015 | Unagami | H05B 6/6435 709/219 |
| 2016/0213187 | A1 | 7/2016 | Meusburger et al. | |
| 2016/0218884 | A1* | 7/2016 | Ebrom | H04L 12/2816 |
| 2017/0008162 | A1* | 1/2017 | Tsubota | H04L 12/282 |
| 2019/0215915 | A1* | 7/2019 | Minvielle | F24C 7/085 |
| 2022/0151033 | A1* | 5/2022 | Franco Gutierrez | H05B 6/062 |

OTHER PUBLICATIONS

United States Patent and Trademark Office, "Non-Final Office Action," issued in connection with U.S. Appl. No. 14/752,451, dated Jun. 27, 2017, 11 pages.

United States Patent and Trademark Office, "Final Office Action," issued in connection with U.S. Appl. No. 14/752,451, dated Nov. 28, 2017, 11 pages.

United States Patent and Trademark Office, "Non-Final Office Action," issued in connection with U.S. Appl. No. 14/752,451, dated Jun. 11, 2018, 11 pages.

United States Patent and Trademark Office, "Non-Final Office Action," issued in connection with U.S. Appl. No. 14/752,451, dated Apr. 30, 2019, 14 pages.

United States Patent and Trademark Office, "Notice of Allowance and Fee(s) Due," issued in connection with U.S. Appl. No. 14/752,451, dated Nov. 14, 2019, 8 pages.

United States Patent and Trademark Office, "Non-Final Office Action," issued in connection with U.S. Appl. No. 14/752,451, dated May 27, 2020, 15 pages.

United States Patent and Trademark Office, "Final Office Action," issued in connection with U.S. Appl. No. 14/752,451, dated Oct. 27, 2020, 6 pages.

United States Patent and Trademark Office, "Notice of Allowance and Fee(s) Due," issued in connection with U.S. Appl. No. 14/752,451, dated Feb. 10, 2021, 6 pages.

United States Patent and Trademark Office, "Advisory Action," issued in connection with U.S. Appl. No. 14/752,451, dated Apr. 18, 2018, 3 pages.

* cited by examiner

TECHNOLOGIES FOR CONTROLLING COOKING APPLIANCES USING SHARED COOKING RECIPES

RELATED APPLICATION

This patent arises from a continuation U.S. patent application Ser. No. 14/752,451 (now U.S. Pat. No. 11,064,579), titled "Technologies For Controlling Cooking Appliances Using Shared Cooking Recipes," and filed on Jun. 26, 2015, which is hereby incorporated by this reference in its entirety.

BACKGROUND

Most cooking appliances, such as microwaves, allow a user to manually set various cooking settings such as power level and cooking duration. However, unless well versed in the use of the particular cooking appliance, the user may inadvertently set an incorrect power level, cooking duration, and/or other cooking setting. Additionally, the complexity of the operation of many cooking appliances can intimidate users, such that they use the cooking appliance to its minimum capabilities.

Some manufacturers of cooking appliances attempt to reduce the complexity to the user by providing pre-settings for particular food items (e.g., baked potatoes, beverage reheat, etc.). However, such pre-settings are oftentimes severely limited in breadth and cannot perform complex cooking recipes that may require multiple cooking cycles at various power levels, cooking durations, and so forth. As such, although a user may obtain a cooking recipe of interest from a friend, book, or the Internet, the user is still faced with the complexity of operating the cooking appliance manually according to the recipe. Additionally, some recipes may be created with expectation that the user will use a cooking appliance of a particular brand or type. Users are faced with further complexity if their cooking appliance is not of the particular brand or type as the user may need to convert cooking settings set forth in the cooking recipe to the proper-settings for their brand and type of cooking appliance.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

DETAILED DESCRIPTION OF THE DRAWINGS

Figure 1:
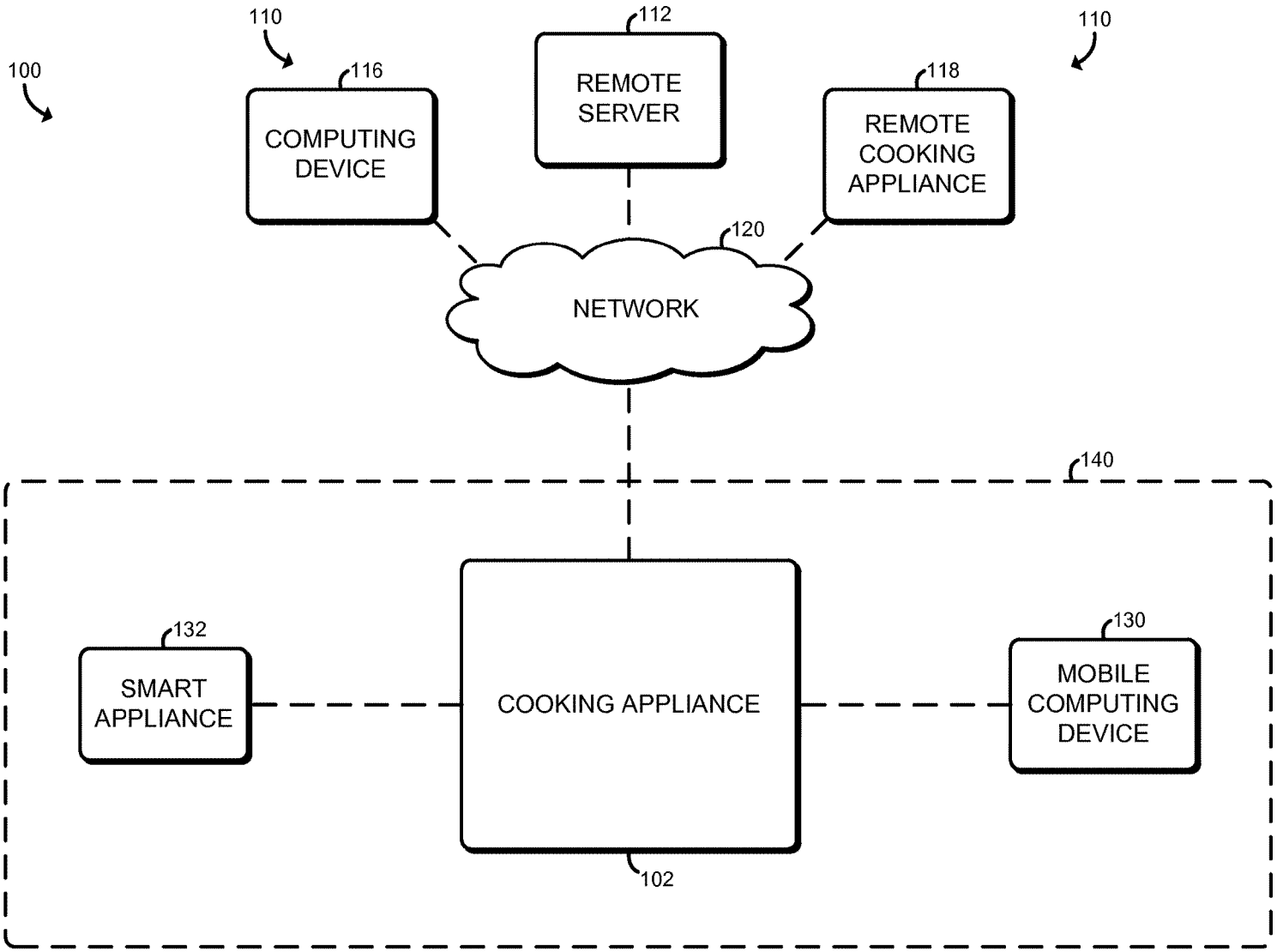
FIG. 1 is a simplified block diagram of at least one embodiment of a system for generating, sharing, and performing a cooking recipe.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

The disclosed embodiments may be implemented, in some cases, in hardware, firmware, software, or any combination thereof. The disclosed embodiments may also be implemented as instructions carried by or stored on a transitory or non-transitory machine-readable (e.g., computer-readable) storage medium, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

Referring now to FIG. 1, a system 100 for generating, sharing, and performing a cooking recipe includes a cooking appliance 102, which may communicate with one or more remote computing devices 110, such as a remote server 112, a computing device 116, and/or a remote cooking appliance 118, over a network 120 to obtain and share cooking recipes. Additionally, the cooking appliance 102 may communicate with a local mobile computing device 130 of a user and/or one or more other smart appliances 132, to perform the cooking recipe. The cooking appliance 102 and one or more smart appliances 132 may be co-located in a residence 140 of the user. Although the illustrative system 100 includes only one remote server 112, computing device 116, remote cooking appliance 118, mobile computing device 130, and smart appliance 132, it should be appreciated that the system 100 may include additional remote servers 112, computing devices 116, remote cooking appliances 118, mobile computing device 130, and/or smart appliances 132 in other embodiments.

In use, the cooking appliance 102 is configured to obtain a cooking recipe from the mobile computing device 130 and/or the remote computing devices 110 over the network 120. As discussed in more detail below, the cooking recipe is embodied as instructions that are executable by the cooking appliance 102 to perform the cooking recipe. The cooking recipe may include one or more cooking steps, and the cooking appliance 102 may perform particular actions in each cooking step. For example, as part of each cooking step, the cooking appliance 102 may automatically adjust cooking settings (e.g., a power or cooking timing setting) of the cooking appliance 102, provide commentary or instructions to a user, notify the user of subsequent cooking steps and requirements (e.g., required ingredients for subsequent cooking steps), communicate with other smart appliances 132 to complete the cooking step, and/or perform other operations. It should be appreciated that some of the cooking operations performed in each cooking step may be performed without direction from the user. For example, the cooking appliance 102 may automatically adjust the power setting and/or cooking timer setting for a particular cooking step without direction or interaction from the user. Such automation of the cooking process may facilitate the cooking of complex cooking recipes.

In some embodiments, the cooking recipe may include one or more digital rights management (DRM) security features. For example, the cooking recipe may include a DRM security feature that limits the number of times the cooking appliance 102 can perform or cook the cooking recipe. Additionally, the DRM security feature may restrict the distribution or sharing of the cooking recipe such that the cooking appliance 102 may be unable to communicate the cooking recipe to the remote computing devices 110, such as the remote cooking appliance 118. As discussed below, the cooking appliance 102 is configured to enforce such DRM security features. Further in some embodiments, the cooking recipe may be encrypted. In such embodiments, the cooking appliance 102 is further configured to decrypt the cooking recipe to allow the cooking appliance 102 to proceed with the performing of the cooking recipe.

As discussed in more detail below, the cooking appliance 102 may also be used to generate a cooking recipe. To do so, a user may operate the cooking appliance 102 to record one or more cooking steps of the cooking recipe to be generated. In each cooking step, the user may control the operation of the cooking appliance 102 (e.g., control the power setting, cooking timer setting, etc.) and provide verbal input, commentary, information and/or instructions, such as the ingredient list. In this way, the user may generate the cooking recipe by actually performing the recipe on the cooking appliance 102. As discussed below, the cooking appliance 102 is configured to generate the executable instructions for each cooking step of the cooking recipe, which may be executed by other cooking appliances (e.g., remote cooking appliance 118) to perform the cooking recipe. The cooking recipe may also include the additional verbal commentary, instructions, and/or information provided by the user, which are played back by the other cooking appliance 102 when performing the cooking recipe. Additionally, the user may add various security features, such as encryption or DRM security features, to the cooking recipe. Such security features facilitate the social sharing of the cooking recipes. For example, once generated, the user of the cooking appliance 102 may share the cooking recipe by transmitting the cooking recipe to her mobile computing device 130 for uploading to the network 120 and/or by transmitting the cooking recipe directly from the cooking appliance 102 (e.g., via an appliance-to-appliance transmission from the cooking appliance 102 to the remote cooking appliance 118).

Figure 2:
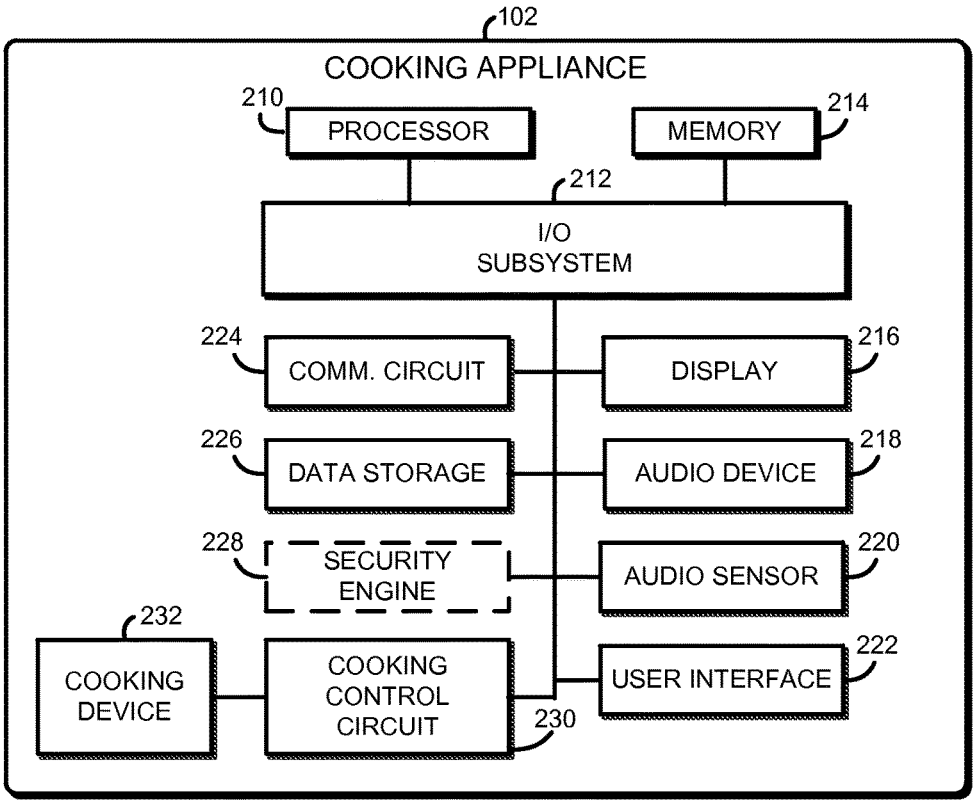
FIG. 2 is a simplified block diagram of at least one embodiment of a cooking appliance of the system of FIG. 1.

Referring now to FIG. 2, the cooking appliance 102 may be embodied as any type of appliance or device capable of performing at least one aspect of a cooking recipe and performing the features described herein. For example, the cooking appliance 102 may be embodied as a smart microwave, a smart oven, a smart toaster, a smart drink maker, a smart refrigerator, a smart cooking pot, pan, or utensil, and/or other smart appliance capable of performing at least one cooking step of a cooking recipe. Such appliances may be known as "smart" because they include some amount of processing power. For example, as shown in FIG. 2, the illustrative cooking appliance 102 includes a processor 210, an 110 subsystem 212, a memory 214, a display 216, an audio device 218, an audio sensor 220, a user interface 222, a communication circuit 224, a data storage 226, a security engine 228, and a cooking control circuit 230. Of course, the cooking appliance 102 may include other or additional components, such as those commonly found in a computer (e.g., various input/output devices), in other embodiments. Additionally, in some embodiments, one or more of the illustrative components may be incorporated in, or otherwise form a portion of, another component. For example, the memory 214, or portions thereof, may be incorporated in the processor 210 in some embodiments.

The processor 210 may be embodied as any type of processor capable of performing the functions described herein. For example, the processor 210 may be embodied as a single or multi-core processor(s), digital signal processor, microcontroller, or other processor or processing/controlling circuit. Similarly, the memory 214 may be embodied as any type of volatile or non-volatile memory or data storage capable of performing the functions described herein. In operation, the memory 214 may store various data and software used during operation of the cooking appliance 102 such as operating systems, applications, programs, libraries, and drivers. The memory 214 is communicatively coupled to the processor 210 via the I/O subsystem 212, which may be embodied as circuitry and/or components to facilitate input/output operations with the processor 210, the memory 214, and other components of the cooking appliance 102. For example, the I/O subsystem 212 may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations. In some embodiments, the I/O subsystem 212 may form a portion of a system-on-a-chip (SoC) and be incorporated, along with the processor 210, the memory 214, and other components of the cooking appliance 102, on a single integrated circuit chip.

The display 216 may be embodied as any type of display capable of displaying digital information to a user such as a liquid crystal display (LCD), a light emitting diode (LED), a plasma display, a cathode ray tube (CRT), or other type of display device. As described below, the display 216 may be used to display a graphical user interface or other information to the user of the cooking appliance 102. Additionally, in some embodiments, the cooking appliance 102 may include a touch screen coupled to or incorporated in the display 216. The touch screen may be used to receive user tactile input.

The audio device 218 may be embodied as any device capable of generating audio signals for output, such as a paper cone speaker, an audio transducer, an audio output jack, a digital-to-analog converter (DAC), or other type of audio device. The audio device 218 may be used by the cooking appliance 102 to provide audible instructions, notifications, and information to the user while performing the cooking recipe as discussed in more detail below.

The audio sensor 220 may be embodied as any sensor capable of capturing audio signals such as a microphone, a line input jack and associated circuitry, an analog-to-digital converter (ADC), or other type of audio sensor. The audio sensor 220 may be used by the cooking appliance 102 to receive verbal commentary, information, and/or instructions from the user in response to inquiries from the cooking appliance 102 and/or as part of a cooking recipe as discussed in more detail below.

The user interface 222 may be embodied as any type of device or collection of devices capable of facilitating user interaction with the cooking appliance 102. For example, the user interface 222 may be embodied as a set of switches, knobs, or the like. Additionally or alternatively, the user interface 222 may include a keyboard and/or mouse. In some embodiments, the user interface 222 may be embodied as the touchscreen associated with the display 216.

The communication circuit 224 may be embodied as any communication circuit, device, or collection thereof, capable of enabling communications between the cooking appliance 102 and the remote computing device 110 via the network 120 and the mobile computing device 130 and/or smart appliance 132. To do so, the communication circuit 224 may be configured to use any one or more communication technology and associated protocols (e.g., Ethernet, Bluetooth®, Wi-Fi®, WiMAX, etc.) to effect such communication.

The data storage 226 may be embodied as any type of device or devices configured for the short-term or long-term storage of data. For example, the data storage 226 may include any one or more memory devices and circuits, memory cards, hard disk drives, solid-state drives, or other data storage devices. The data storage 226 may store various data used by the cooking appliance 102 during operation. For example, in some embodiments, the data storage 226 may store cooking recipes received from the remote computing devices 110 or the mobile computing device 130, as well as cooking recipes generated by the user.

In some embodiments, the cooking appliance 102 may include the security engine 228. The security engine 228 may be embodied as any hardware component(s) or circuitry capable of implementing various security-related services and functions (e.g., cryptographic functions, DRM functions, etc.) for the cooking appliance 102. In particular, the security engine 228 may include a microprocessor, microcontroller, or other embedded controller capable of executing firmware and/or other code independently and securely from the processor 210. The security engine 228 may communicate with the processor 210 and/or other components of the cooking appliance 102 over a dedicated bus, such as a host embedded controller interface (HECI). In some embodiments, the security engine 228 may be embodied as a converged security and manageability engine (CSME), a manageability engine, an out-of-band processor, a Trusted Platform Module (TPM), or other security engine device or collection of devices. Further, in some embodiments, the security engine 228 is also capable of communicating using the communication circuit 224 or a dedicated communication circuit independently of the state of the cooking appliance 102 (e.g., independently of the state of the main processor 210), also known as "out-of-band" communication.

The cooking control circuit 230 may be embodied as any type of control circuit capable of controlling a corresponding cooking device 232 of the cooking appliance 102. For example, the cooking control circuit 230 may control a power level, cooking duration, and/or other cooking setting or cooking parameter of the cooking device 232. The cooking device 232 may be embodied as any type of device capable of performing a cooking function, which may or may not involve the heating of the food or beverage (e.g., the cooking function may involve stirring or mixing). For example, in those embodiments in which the cooking appliance 102 is embodied as a microwave, the cooking device 232 may be embodied as, or otherwise include, a magnetron.

In some embodiments, the cooking appliance 102 may also include one or more peripheral devices (not shown). The peripheral devices may include any type of peripheral device commonly found in a cooking appliance and/or computer, such as various input/output devices.

Referring back to FIG. 1, as discussed above, the cooking appliance(s) 102 may be configured to communicate with the remote computing devices 110 over the network 120 to socially share cooking recipes. The remote server 112 of the remote computing devices 110 may be embodied as any type of computing device capable of communicating with the cooking appliance 102 and performing the functions described herein. In use, the remote server 112 may perform as a cooking recipe repository and server, and the remote server 112 may distribute cooking recipes between cooking appliances 102, 118 and other computing devices of the system 100. The remote server 112 may be embodied as, for example, a server, a rack-mounted server, a blade server, a network appliance, a web appliance, a distributed computing system, a processor-based system, a mobile computing device, a smartphone, a tablet computer, a computer, a laptop computer, a desktop computer, multiprocessor system, and/or a consumer electronic device. As such, the remote server 112 may include components commonly found in a computing device. For example, the remote server 112 may include one or more processors, memory, I/O subsystems, and communication circuits. Those components of the remote server 112 may be similar to the corresponding components of the cooking appliance 102, the description of which is equally applicable to the components of the remote server 112 and is not repeated herein for the clarity of description.

The computing device(s) 116 may be embodied as any type of computing device capable of communicating with the cooking appliance 102 over the network 120 and performing the functions described herein. In use the computing device 116 may share cooking recipes with the cooking appliance 102, either directly or via an intermediary computing device such as the remote server 112 or mobile computing device 130. The computing device 116 may be embodied as, for example, a smartphone, a tablet computer, a laptop computer, a notebook, a desktop computer, a server, a distributed computing system, a multiprocessor system, a multi-computer system, and/or other computing device. As such, the computing device 116 may include components commonly found in a computing device. For example, the computing device 116 may include one or more processors, memory, I/O subsystems, and communication circuits. Those components of the computing device 116 may be similar to the corresponding components of the cooking appliance 102, the description of which is equally applicable to the components of the computing device 116 and is not repeated herein for the clarity of description.

Similar to the cooking appliance 102, the remote cooking appliance 118 may be embodied as any type of appliance or device capable of performing at least one aspect of a cooking recipe and performing the features described herein. For example, the remote cooking appliance 118 may be embodied as a smart microwave, a smart oven, a smart toaster, a smart drink maker, a smart refrigerator, a smart cooking pot, pan, or utensil, and/or other smart appliance capable of performing at least one cooking step of a cooking recipe. As such, the remote cooking appliance 118 may be similar to the cooking appliance 102 and may include components commonly found in a cooking appliance and/or computing device. For example, the remote cooking appliance 118 may include one or more processors, memory, I/O subsystems, and communication circuits. Those components of the remote cooking appliance 118 may be similar to the corresponding components of the cooking appliance 102, the description of which is equally applicable to the components of the remote cooking appliance 118 and is not repeated herein for the clarity of description.

The mobile computing device 130 may be embodied as any type of mobile computing device capable of performing the functions described herein. In use, the mobile computing device 130 may communicate with the cooking appliance 102 (e.g., via a local network or communication protocol, such as BlueTooth™) to supply cooking recipes to the cooking appliance 102 and receive cooking recipes from the cooking appliance 102 for sharing with other computing devices, such as the remote computing devices 110. The mobile computing device 130 may be embodied as, for example, a smartphone, a tablet computer, a wearable computing device, a pair of smart glasses, a head-mounted computing device, a cellular phone, a laptop computer, a notebook, a netbook, an Ultrabook™, a smart device, a personal digital assistant, a mobile Internet device, and/or any other computing/communication device. As such, the mobile computing device 130 may include components commonly found in a computing device. For example, the mobile computing device 130 may include one or more processors, memory, I/O subsystems, and communication circuits. Those components of the mobile computing device 130 may be similar to the corresponding components of the cooking appliance 102, the description of which is equally applicable to the components of the mobile computing device 130 and is not repeated herein for the clarity of description.

Again, similar to the cooking appliance 102, the smart appliance 132 may be embodied as any type of appliance or device capable of performing at least one aspect of a cooking recipe and performing the features described herein. In some embodiments, the smart appliance 132 may be similar to the cooking appliance 102 (e.g., a pair of microwaves or ovens); however, in other embodiments the smart appliance 132 may be embodied as an appliance that is different from the cooking appliance 102 hut used in a cooking recipe. For example, the cooking appliance 102 may be embodied as a microwave oven, and the smart appliance 132 may be embodied as a blender. As discussed in more detail below, the cooking appliance 102 may be configured to transmit instructions to the smart appliance 132 to facilitate the performance of the cooking recipe.

The smart appliance 132 may be embodied as, for example, a smart blender, a smart mixer, smart microwave, a smart oven, a smart toaster, a smart drink maker, a smart refrigerator, a smart cooking pot, pan, or utensil, and/or other smart appliance capable of performing at least one cooking step of a cooking recipe. As such, the smart appliance 132 may be similar to the cooking appliance 102 and may include components commonly found in a cooking appliance and/or computing device. For example, the smart appliance 132 may include one or more processors, memory, I/O subsystems, and communication circuits. Those components of the smart appliance 132 may be similar to the corresponding components of the cooking appliance 102, the description of which is equally applicable to the components of the smart appliance 132 and is not repeated herein for the clarity of description.

The network 120 may be embodied as any type of wired or wireless communication network, including cellular networks (e.g., Global System for Mobile Communications (GSM), 3G, Long Term Evolution (LTE), Worldwide Interoperability for Microwave Access (WiMax), etc.), digital subscriber line (DSL) networks, cable networks (e.g., coaxial networks, fiber networks, etc.), telephony networks, local area networks (LANs) or wide area networks (WANs), global networks the Internet), or any combination thereof. Additionally, the network 120 may include any number of network devices as needed to facilitate communication between the cooking appliance 102 and the remote computing devices 110.

Figure 3:
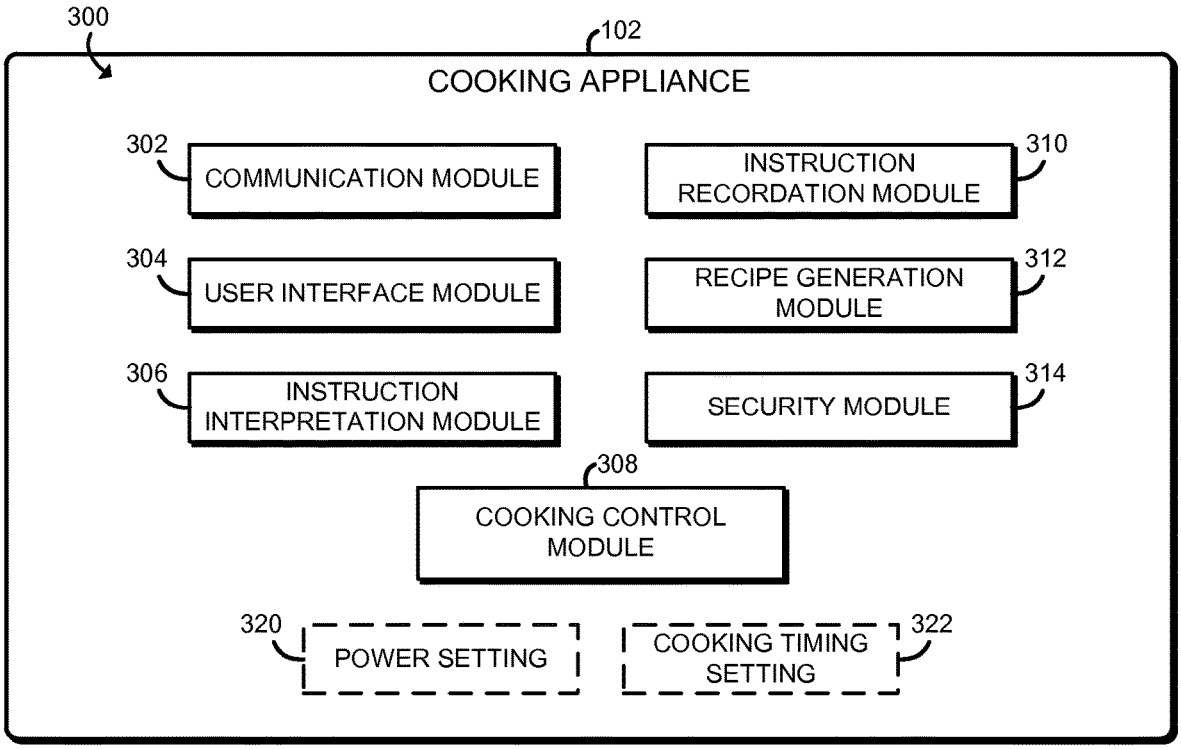
FIG. 3 is a simplified block diagram of at least one embodiment of an environment that may be established by the cooking appliance of FIG. 2.

Referring now to FIG. 3, in use, the cooking appliance 102 establishes an environment 300. The illustrative environment 300 includes a communication module 302, a user interface module 304, an instruction interpretation module 306, a cooking control module 308, an instruction recordation module 310, a recipe generation module 312, and a security module 314. Each of the modules and other components of the environment 300 may be embodied as firmware, software, hardware, or a combination thereof. For example the various modules, logic, and other components of the environment 300 may form a portion of, or otherwise be established by, the processor 210, the I/O subsystem 212, an SoC, or other hardware components of the cooking appliance 102. As such, in some embodiments, any one or more of the modules of the environment 300 may be embodied as a circuit or collection of electrical devices (e.g., a communication circuit, a user interface circuit, an instruction interpretation circuit, a cooking control circuit, an instruction recordation circuit, a recipe generation circuit, and a security circuit, etc.).

The communication module 302 is configured to facilitate communications between the cooking appliance 102 and other devices of the system 100, For example, the communication module 302 may establish communication links, via the communication circuit 224, with one or more of the remote computing devices 110 to retrieve or share cooking recipes. Additionally, the communication module 302 facilitates communications with the mobile computing device 130 to receive or share cooking recipes and with the smart appliance 132 to provide cooking instructions to the smart appliance 132 based on the particular cooking recipe.

The user interface module 304 is configured to provide an interface to a user for interaction with the cooking appliance 102. For example, the user interface module 304 may receive user input from the user interface 222 and/or the touchscreen of the display 216. Additionally the user interface module 304 is configured to control or manage the audio device 218 and the audio sensor 220. For example, the user interface module 304 may receive vocal instructions or data via the audio sensor 220 and generate audible instructions, notifications, and information via the audio sensor 220 during performance of a cooking recipe as discussed in more detail below.

When necessary, the instruction interpretation module 306 is configured to convert a cooking recipe to a native recipe format that is understandable or executable by the cooking appliance 102. That is, the cooking appliance 102 may be configured only to execute those executable instructions of a cooking recipe that are in the correct format or protocol expected by the cooking appliance 102 (i.e., the "native" recipe format). However, cooking recipes generated by cooking appliances from a different manufacturer or type may be of a format that is different from the native recipe format of the cooking appliance 102. For example, the cooking recipe may be in a manufacturer-specific recipe format that is different from the native recipe format of the cooking appliance 102. In such embodiments, the instruction interpretation module 306 is configured to convert the cooking recipe from the manufacturer-specific recipe format to the native recipe format for execution by the cooking appliance 102. To facilitate the sharing of cooking recipes amongst cooking appliances from different manufacturers, the cooking recipe may be alternatively formatted in a manufacturer-independent recipe format, such as a universally recognized format. In such embodiments, the instruction interpretation module 306 is configured to interpret the cooking recipe from the manufacturer-independent recipe format to the native recipe format for execution by the cooking appliance 102. The instruction interpretation module 306 may perform such conversion or interpretation using any suitable algorithm or data. For example, in some embodiments, the cooking appliance 102 may include a language dictionary or conversion chart in the data storage 226.

The cooking control module 308 is configured to control the cooking operation of the cooking appliance 102 based on the executable instructions included in the cooking recipe. That is, the cooking control module 308 may execute the executable instructions, or a portion thereof, to control various operations of the cooking appliance 102. For example, the cooking control module 308 may control various cooking settings of the cooking control circuit 230 and/or cooking device 232, such as a power setting 320 and/or a cooking timing setting 322. Of course, the cooking control module 308 may control other settings or features of the cooking appliance 102 during the performance of the cooking recipe.

As discussed above, a user of the cooking appliance 102 may also use the appliance 102 to generate a cooking recipe. As such, the instruction recordation module 310 is configured to record operation of the cooking appliance 102 by the user. For example, the user may step through multiple cooking steps of the cooking recipe and, in each cooking step, control operation of the cooking appliance 102 via interaction with the user interface module 304. For example, the user may set a power setting or cooking timer setting of the cooking appliance 102 and, in response, the instruction recordation module 310 will record such operation, including the reference power setting and reference cooking timer setting provided by the user. Additionally, as discussed in more detail below, the user may provide verbal commentary, information, and/or instructions, such as the ingredient list, a preparation step, or background information. In such embodiments, the instruction recordation module 310 may receive the verbal input via the audio sensor 220 and record the verbal input in association with any control operations performed by the user during the same time period. As such, the verbal input may be replayed to a new user of a different cooking appliance while the different cooking appliance is performing the particular cooking step of the generated cooking recipe as discussed in more detail below.

The recipe generation module 312 is configured to generate the cooking recipe based on the user operation of the cooking appliance 102, the user's verbal input, and other information recorded by the instruction recordation module 310. As discussed above, the cooking recipe may include one or more cooking steps, each of which include executable instructions that may be executed by the cooking appliance 102 (or other cooking appliance) to perform the cooking recipe. The recipe generation module 312 may be configured to generate the cook recipe in a native recipe format or protocol (e.g., a manufacturer-specific recipe format) and/or in a manufacturer-independent recipe format. As discussed in more detail below, the cooking recipe may be embodied as any type data and/or set of instructions executable by the cooking appliance 102. For example, in some embodiments, the cooking recipe is embodied as HyperText Markup Language (HTML), Extensible Markup Language (XML), or direct binary instructions. Regardless, once the cooking recipe is generated, the communication module 302 may share the cooking recipe with the remote computing devices 110 and/or the mobile computing device 130 of the user.

The security module 314, which may be implemented by the security engine 228, is configured to perform the various security functions of the cooking appliance 102. For example, the security module 314 may be configured to decrypt received cooking recipes or encrypt generated cooking recipes. To do so, the security module may use any suitable cryptographic algorithm such as Rivest-Shamir-Adleman (RSA), Elliptic Curve Cryptography (ECC), Digital Signature Algorithm (DSA), Galois/Counter Mode (GCM), Offset Codebook Mode (OCB), Counter with Cipher Block Chaining Message Authentication Code (CCM), Encrypt-then-MAC (EtM), and/or other cryptographic schemes. Additionally, as discussed in more detail below, the security module 314 is configured to enforce DRM security features of the cooking recipe on the cooking appliance 102, as well as apply desired DRM security features to newly generated cooking recipes. For example, based on the particular enabled DRM security features, the security module 314 may limit the number of times the cooking appliance 102 can perform or cook the cooking recipe, restrict the distribution or sharing of the cooking recipe, and/or perform other DRM security services.

Figure 4:
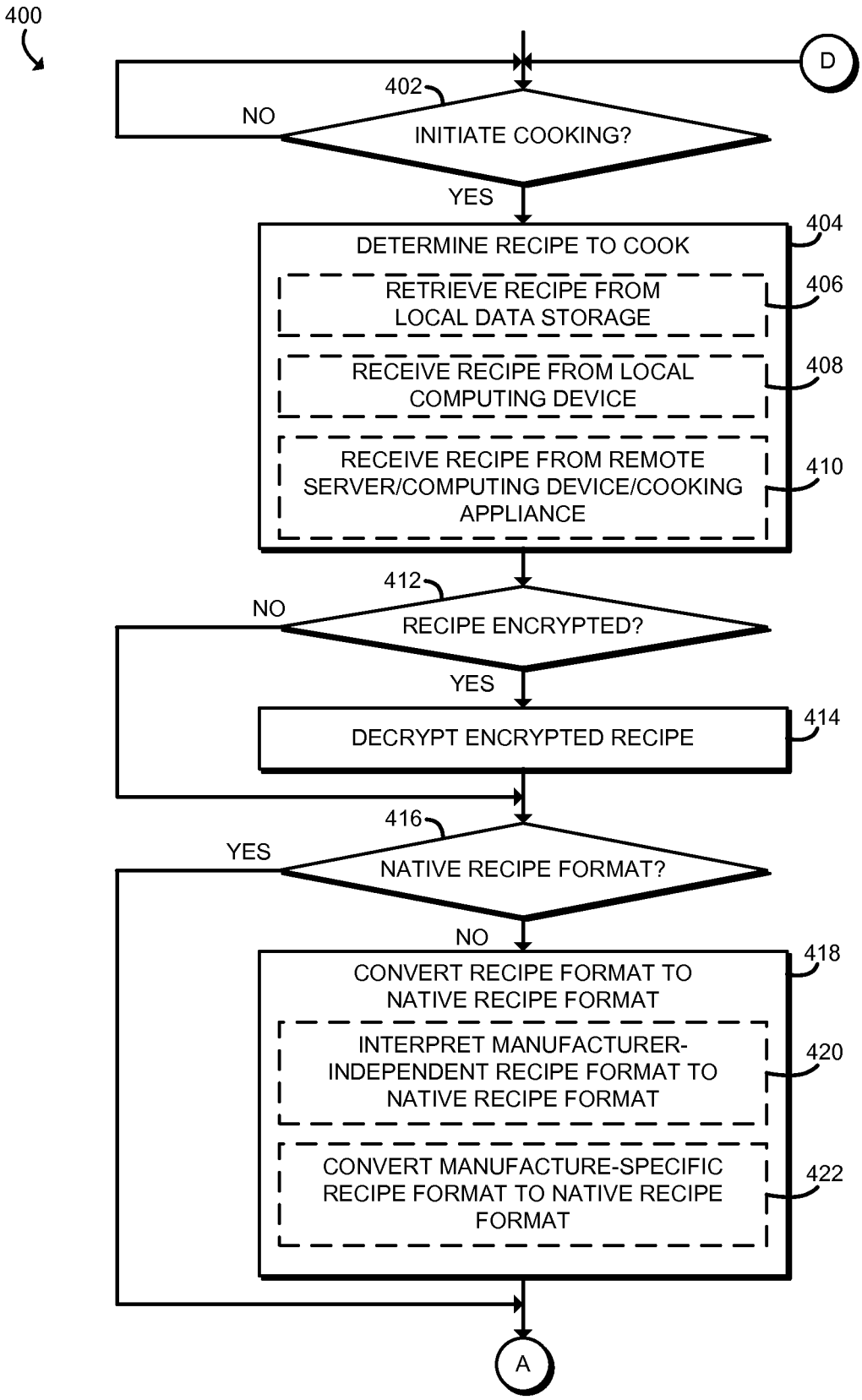
FIGS. 4-6 are a simplified flow diagram of at least one embodiment of a method for performing a cooking recipe that may be executed by the cooking appliance of FIGS. 2 and 3.
Figure 5:
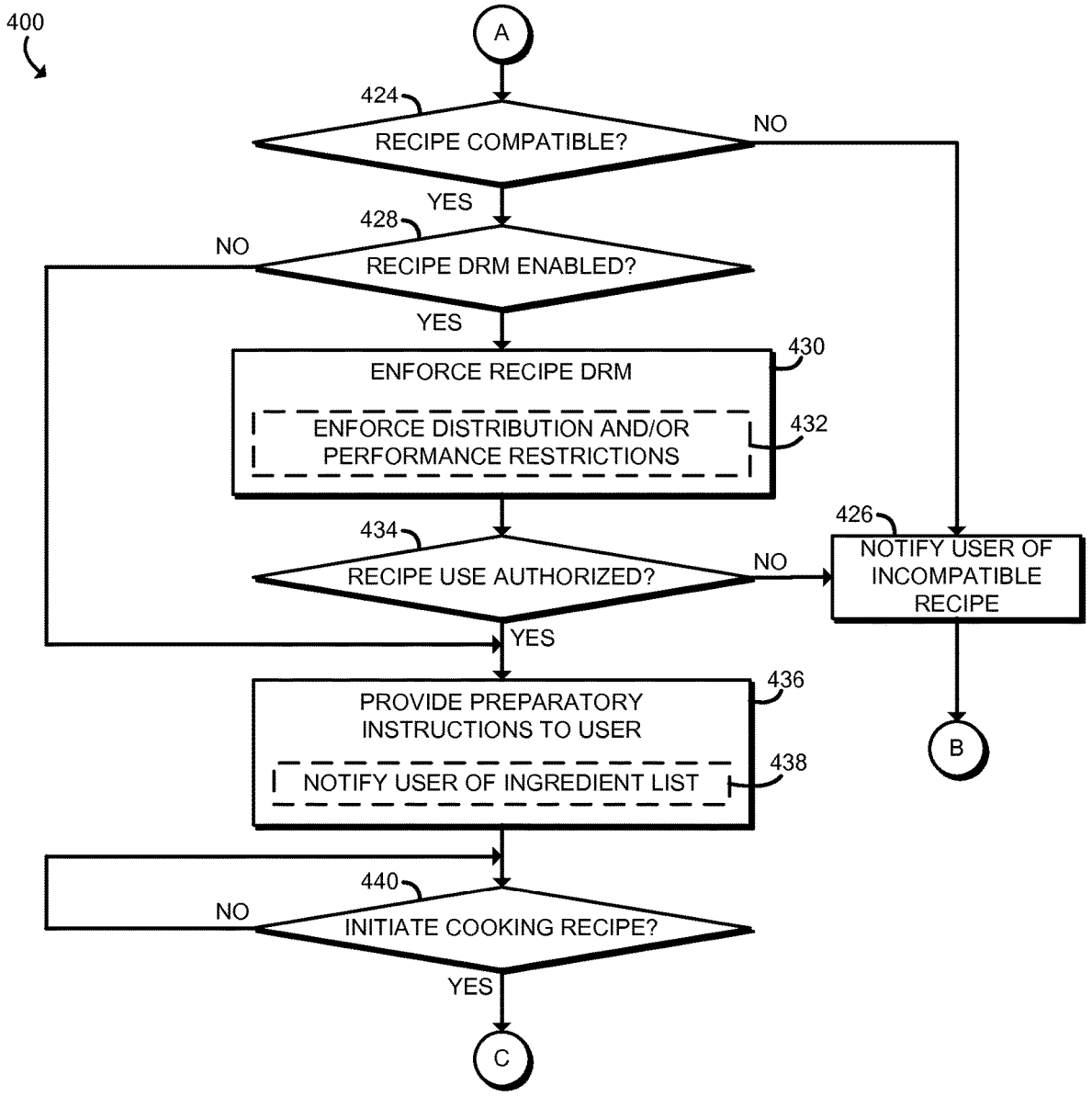
Figure 6:
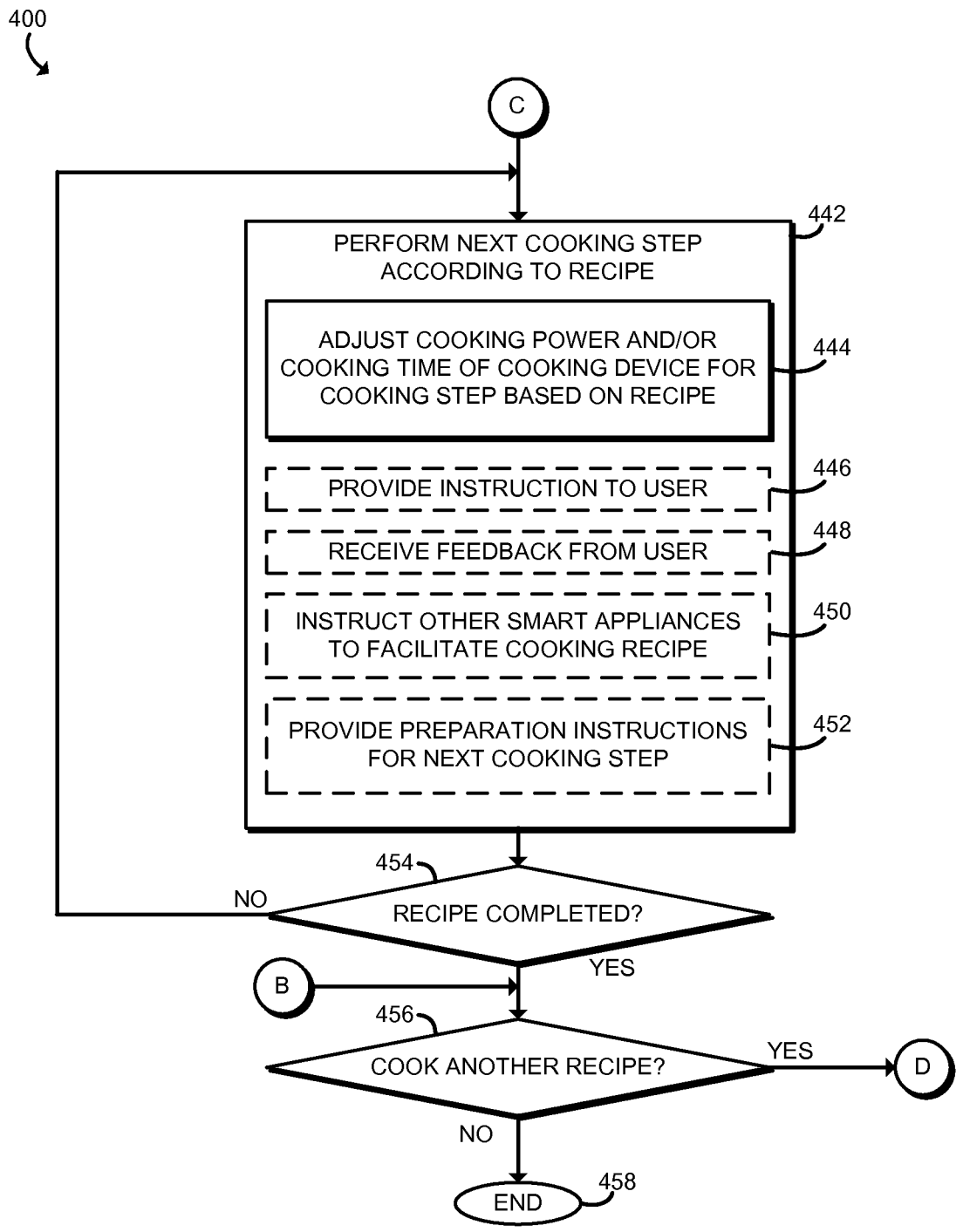

Referring now to FIGS. 4-6, in use, the cooking appliance 102 may execute a method 400 for cooking or performing a cooking recipe. The method 400 begins with block 402 in which the cooking appliance 102 determines whether the user desires to initiate cooking. For example, the user may interact with the cooking appliance 102 via the user interface 222 to initiate the cooking or performance of a cooking recipe. If so, the method 400 advances to block 404 in which the cooking appliance 102 determines which cooking recipe the user desires to perform. For example, in some embodiments, the cooking appliance 102 may store cooking recipes in the local data storage 226. In such embodiments, the user may interact with the user interface 222 to review and select a desired cooking recipe and, in response, the cooking appliance 102 may retrieve the cooking recipe from the local data storage 226 in block 406. Alternatively, the cooking appliance 102 may receive the desired cooking recipe from the mobile computing device 130 in block 408. For example, the user may retrieve a cooking recipe from the remote server 112 using the mobile computing device 130 and subsequently transmit the cooking recipe to the cooking appliance 102. Further, in some embodiments, the cooking appliance 102 may be configured to retrieve or receive the cooking recipe directly from one of the remote computing devices 110, such as the remote server 112, the computing device 116, and/or the remote cooking appliance 118, in block 410.

Regardless, after the cooking appliance 102 obtains the desired cooking recipe in block 404, the method 400 advances to block 412 in which the cooking appliance 102 determines whether the cooking recipe is encrypted. As discussed above, the cooking recipes may be encrypted in some embodiments. If so, the method 400 advances to block 414 in which the security module 314 decrypts the cooking recipe. As discussed above, the security module 314 may use any suitable cryptographic algorithm to encrypt/decrypt the cooking recipes.

In block 416, the cooking appliance 102 determines whether the cooking recipe is in the native recipe format of the cooking appliance 102. As discussed above, the cooking recipe may be in a manufacturer-specific recipe format, a manufacturer-independent format, or the native recipe format used by the cooking appliance 102 (which may be the same as the manufacturer-specific recipe format in some cases). If the cooking recipe is in the native recipe format of the cooking appliance 102, the method 400 advances to block 424 of FIG. 5 discussed below. If, however, the cooking appliance 102 determines that the cooking recipe is not in the native format, the method 400 advances to block 418 in which the instruction interpretation module 306 of the cooking apparatus 102 converts the cooking recipe format to the native recipe format. For example, if the cooking recipe is in a manufacturer-independent recipe format, the cooking apparatus 102 interprets the manufacturer-independent recipe format to the native recipe format in block 420. Alternatively, if the cooking recipe is in a manufacturer-specific recipe format unusable by the cooking appliance 102, the cooking appliance 102 converts the cooking recipe format from the manufacturer-specific recipe format to the native recipe format usable by the cooking apparatus 102. As discussed above, the cooking apparatus 102 may use any suitable algorithm or data to convert or interpret the cooking recipe. For example, the cooking appliance 102 may access a language dictionary or conversion chart to facilitate the conversion/interpretation of the cooking recipe.

After the cooking recipe format has been converted in block 418 or if no conversion was required, the method 400 advances to block 424 of FIG. 5. In block 424, the cooking apparatus 102 determines whether the cooking recipe is compatible with the cooking apparatus 102. For example, the cooking recipe may require cooking settings not included in the cooking apparatus 102 or require additional smart appliances 132 not available to the cooking apparatus 102. Additionally, the cooking recipe may be corrupted or otherwise un-executable by the cooking apparatus 102. In such cases, the method 400 advances to block 426 in which the cooking appliance 102 notifies the user of the incompatible recipe. For example, the cooking recipe may display a notification on the display 216 and/or announce an audible notification via the audio device 218. Regardless, after the cooking apparatus 102 generates the notification in block 426, the method 400 advances to block 456 of FIG. 6 described below.

Referring back to block 424, if the cooking apparatus 102 determines that the cooking recipe is compatible, the method 400 advances to block 428. In block 428, the cooking apparatus determines whether the cooking recipe has a DRM security feature enable. If not, the method 400 advances to block 436 discussed below. If, however, the cooking recipe does have one or more DRM security features enabled, the method 400 advances to block 430. In block 430, the cooking appliance 102 enforces the cooking recipe DRM security feature(s). For example, in block 432, the cooking appliance 102 may restrict the user from further distributing or transmitting the cooking recipe from the cooking apparatus 102. Additionally, in block 432, the cooking appliance 102 may limit the number of times the cooking recipe can be performed by the cooking apparatus 102. For example, if the maximum number of performances for the particular cooking recipe has been reached, the cooking apparatus 102 may refuse to proceed with the cooking recipe. As such, in block 434, the cooking apparatus 102 determines whether use of the cooking recipe is authorized based on the DRM security features associated with the cooking recipe. If the cooking recipe is not authorized, the method 400 advances to block 426.

If, however, the cooking recipe is determined to be authorized in block 434 or if no DRM security features are enabled in block 428, the method 400 advances to block 436. In block 436, the cooking apparatus 102 provides any preparatory instructions included in the cooking recipe to the user. For example, the cooking apparatus 102 may provide a list of the ingredients used in the cooking recipe to the user in block 438. The cooking apparatus 102 may use any medium to provide the preparatory instructions. For example, in some embodiments, the cooking apparatus 102 may playback a verbal preparatory commentary, information, and/or instructions via the audio device 218 and/or display a preparatory instruction via the display 216.

Subsequently, in block 440, the cooking apparatus 102 determines whether the user is ready to initiate the cooking steps of the cooking recipe. If so, the method 400 advances to block 442 of FIG. 6. In block 442, the cooking apparatus 102 performs the next cooking step of the cooking recipe. As discussed above, the cooking recipe may include one, two, or more cooking steps, each of which may include executable instructions that are executable by the cooking apparatus 102 to perform the corresponding cooking step. Such instructions may dictate how to control the operation of the cooking device 232, whether verbal or visual commentary and/or instructions should be provided to the user, whether instructions should be sent to the smart appliance 132, and so forth. As such, in block 442, the cooking apparatus 102 executes the executable instructions corresponding to the next cooking step. For example, in block 444, the cooking apparatus 102 may adjust the power setting and/or cooking timing setting (or other cooking setting) of the cooking device 232 to a reference power setting or reference cooking timing setting defined by the executable instructions of the cooking recipe. Additionally, in block 446, the cooking apparatus 102 may provide instructions to the user while the cooking apparatus 102 is performing the next cooking step (e.g., while cooking or warming a food item). For example, the cooking appliance 102 may provide visual instructions via the display 216 or audible instructions via the audio device 218. Further, in block 448, the cooking apparatus 102 may receive feedback, instructions, or other information from the user while the cooking apparatus 102 is performing the next cooking step. Such feedback or other information may be in response to prompts issued by the cooking appliance 102. Additionally, as discussed above, some cooking steps of the cooking recipe may require assistance by another smart appliance 132. In such embodiments, the cooking appliance 102 may transmit an instruction to the smart appliance 132 in block 450 based on the cooking recipe. In some embodiments, the cooking apparatus 102 may also provide preparation instructions to the user for the next cooking step in block 452. As with the instructions for the present cooking step, the cooking appliance 102 may provide visual instructions via the display 216 or audible instructions via the audio device 218.

After the cooking apparatus 102 has performed the present cooking step of the cooking recipe, the method 400 advances to block 454 in which the cooking appliance 102 determines whether the performance of the cooking recipe is completed. If not, the method 400 loops back to block 442 in which the cooking apparatus 102 performs the next cooking step of the cooking recipe (e.g., the cooking apparatus 102 executes the next set of executable instructions corresponding to the next cooking step). If, however, the cooking apparatus 102 determines that the performance of the cooking recipe is completed, the method advances to block 456. In block 456, the cooking apparatus 102 determines whether the user desires to cook or perform another cooking recipe. If so, the method 400 loops back to block 402 of FIG. 4 in which the cooking appliance 102 determines whether the user is ready to initiate cooking again. If not, the method 400 ends in block 458.

Figure 7:
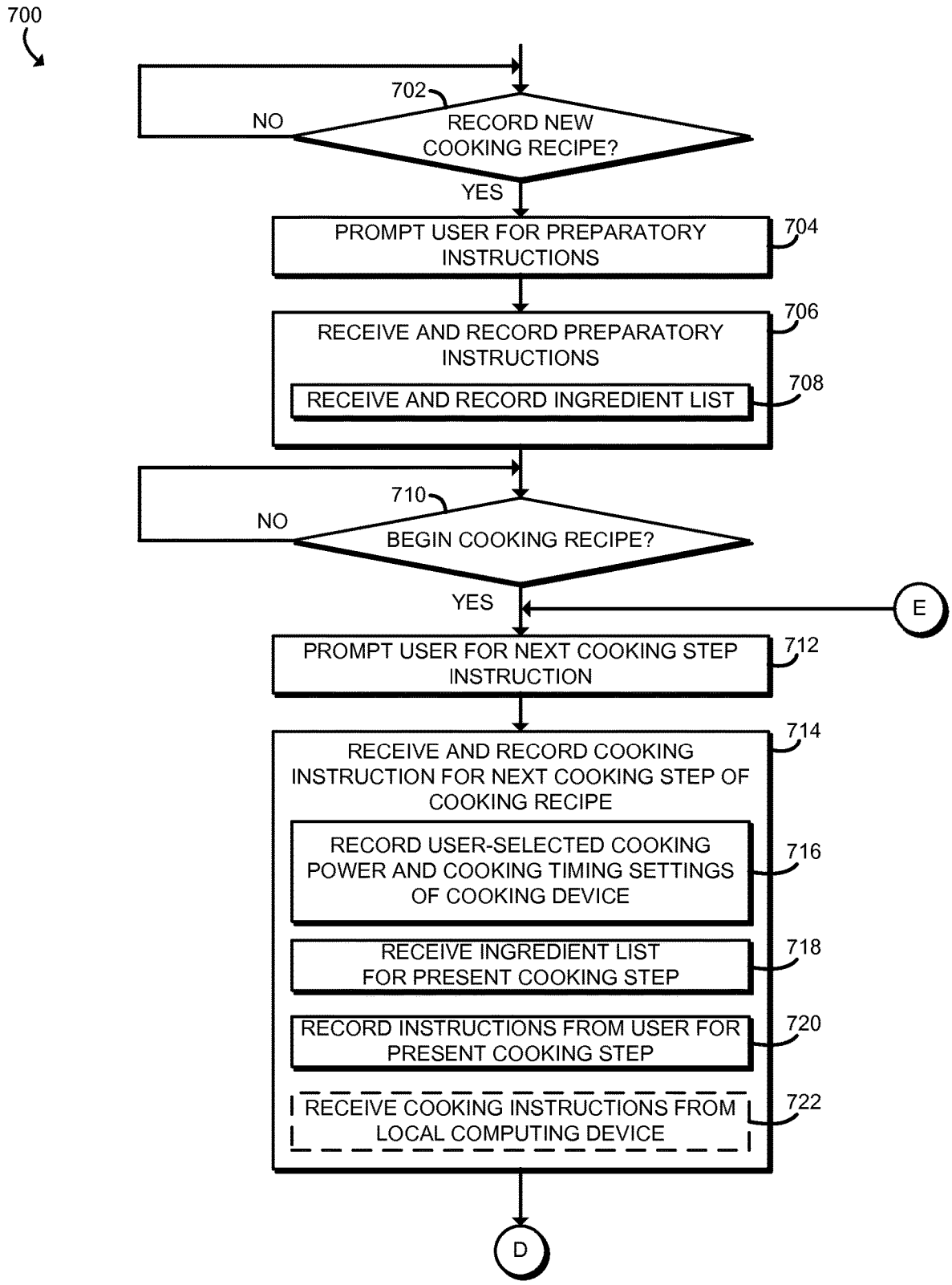
FIGS. 7 and 8 are a simplified flow diagram of at least one embodiment of a method for generating a cooking recipe that may be executed by the cooking appliance of FIGS. 2 and 3.
Figure 8:
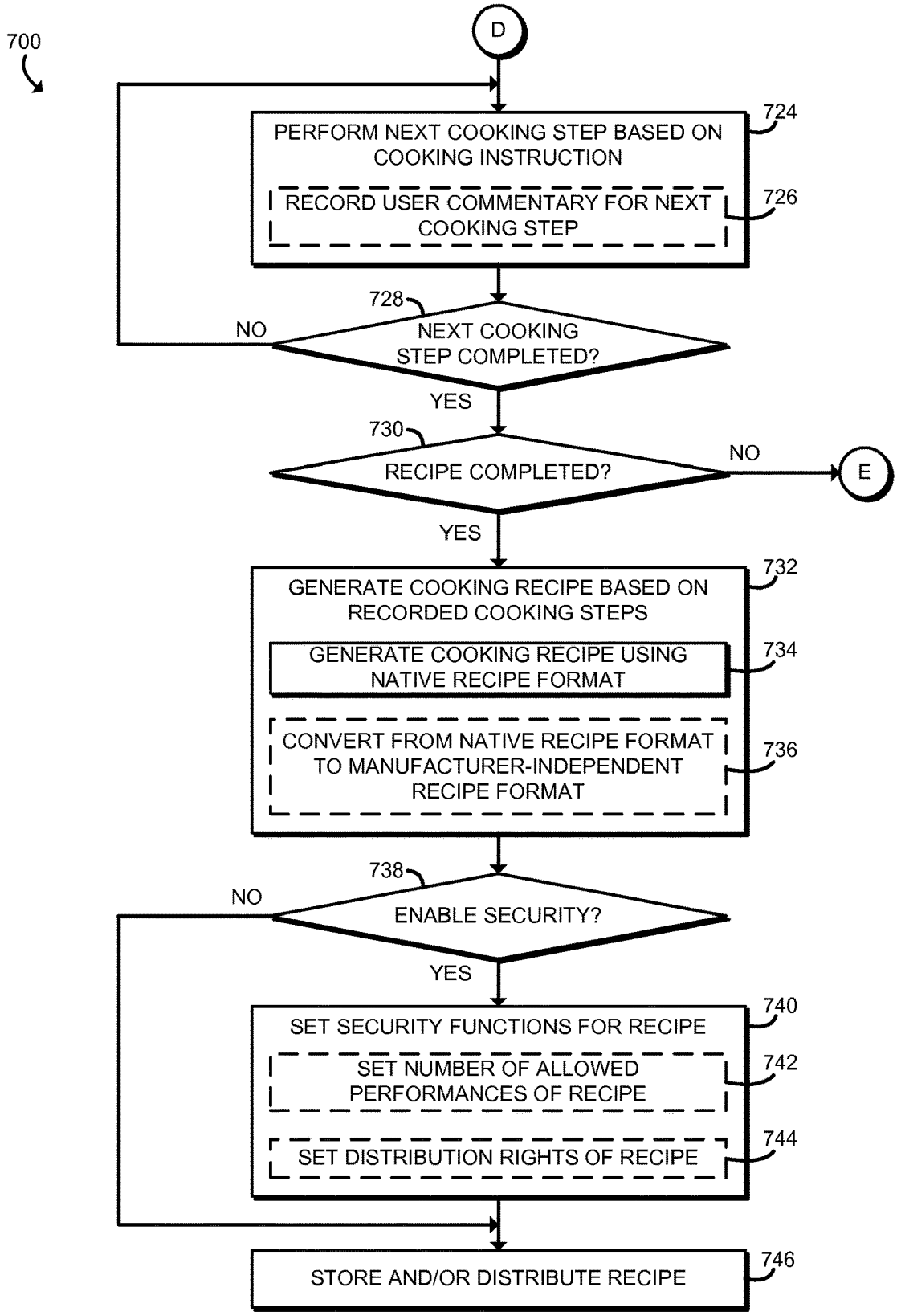

Referring now to FIGS. 7 and 8, in use, the cooking appliance 102 may also execute a method 700 for generating a cooking recipe. The method 700 begins with block 702 in which the cooking apparatus determines whether the user desires to record a new cooking recipe. For example, the user may interact with the cooking appliance 102 via the user interface 222 to initiate the recording of a new cooking recipe. If so, the method 700 advances to block 704 in which the cooking appliance 102 prompts the user for any preparatory instructions. To do so, the cooking appliance 102 may generate an inquiry for the preparatory instructions on the display 216 or via the audio device 218. In block 706, the cooking appliance 102 receives and records any preparatory instructions or other information the user may provide. For example, in block 708, the cooking appliance 102 may receive and record an ingredient list for the new cooking recipe. Subsequently, in block 710, the cooking apparatus 102 determines whether the user is ready to begin the cooking recipe.

If the user is ready to begin the cooking recipe, the method 700 advances to block 712 in which the cooking appliance 102 prompts the user for any the next cooking step instruction. As discussed above, a cooking recipe may include one or more cooking steps. Again, the cooking appliance 102 may prompt the user by generating an inquiry for the instructions on the display 216 or via the audio device 218. In block 714, the cooking appliance 102 receives and records the cooking instructions for the next cooking step of the cooking recipe. For example, in block 716, the cooking apparatus 102 may record any user-selected cooking settings selected or set by the user during the present cooking step. For example, the cooking apparatus may record a reference power setting and/or a reference cooking timing setting selected by the user. Additionally, in block 718, the cooking apparatus 102 may receive an ingredient list of those ingredient used in the present cooking step. The user may supply such ingredient list via the user interface 222, the audio sensor 220, or by transmitting the ingredient list from the user's mobile computing device 130. Further, if the user provides any additional verbal commentary, information, and/or instructions associated with the present cooking step, the cooking apparatus 102 records such instructions or commentary in block 720. Additionally, in some embodiments, the cooking apparatus 102 may receive prepared cooking instructions, or partial instructions from the mobile computing device 130 of the user. For example, the user may draft the cooking instructions on his mobile computing device 130 and subsequently transmit the cooking instructions to the cooking appliance 102 in block 722.

After the cooking appliance 102 has received and recorded the cooking instructions for the present cooking step in block 714, the method 700 advances to block 724 of FIG. 8. In block 724, the cooking apparatus 102 performs the present cooking step based on the cooking instructions provided by the user in block 714. For example, the cooking apparatus 102 may initiate a heating, mixing, or warming cycle pursuant to cooking instructions received from or set by the user in block 714. Additionally, during the performance of the cooking step instructions, the cooking apparatus 102 may record any additional commentary the user may provide. Again, the user may provide such commentary via the audio sensor 220 or the user-interface 222. In block 728, the cooking apparatus 102 determines whether the next cooking step is completed. If not, the method 700 loops back to block 724 in which the cooking apparatus continues to perform the next cooking step based on the user's cooking instructions provided in block 714, If, however, the cooking apparatus 102 has completed the next cooking step, the method 700 advances to block 730 in which the cooking apparatus 102 determines whether the cooking recipe is completed. Again, for example, the user may instruct the cooking apparatus that the cooking recipe is complete via user interface 222. If not, the method 700 loops back to block 712 of FIG. 7 in which the cooking apparatus prompts the user for the next cooking step of the cooking recipe. If, however, the cooking apparatus 102 determines that the cooking recipe is complete, the method 700 advances to block 732.

In block 732, the cooking apparatus generates the cooking recipe based on the recorded cooking steps performed by the user in block 714. To do so, as discussed above, the cooking appliance 102 generates the executable instructions for each cooking step that are executable by the cooking appliance 102 to perform the corresponding cooking step. The cooking appliance 102 may generate the cooking recipe using the native cooking format of the cooking appliance 102 in block 734. Additionally, in some embodiments, the cooking appliance 102 may convert the cooking recipe from the native cooking format to a manufacturer-independent recipe format in block 736.

Subsequently, in block 738, the cooking apparatus 102 determines whether the user desires to enable any security features, such as encryption or DRM security features, for the cooking recipe. If so, the method 700 advances to block 740 in which the cooking apparatus 102 sets the desired security features for the cooking recipe. For example, the cooking apparatus 102 may encrypt the cooking recipe, set the number of allowance performances in block 742, set distribution rights in block 744, and so forth. After the security functions of the cooking recipe have been enabled or if no security functions are desired, the method 700 advances to block 746 in which the newly generated cooking recipe is stored in the local data storage 226 and distributed as desired by the user.

Figure 9:
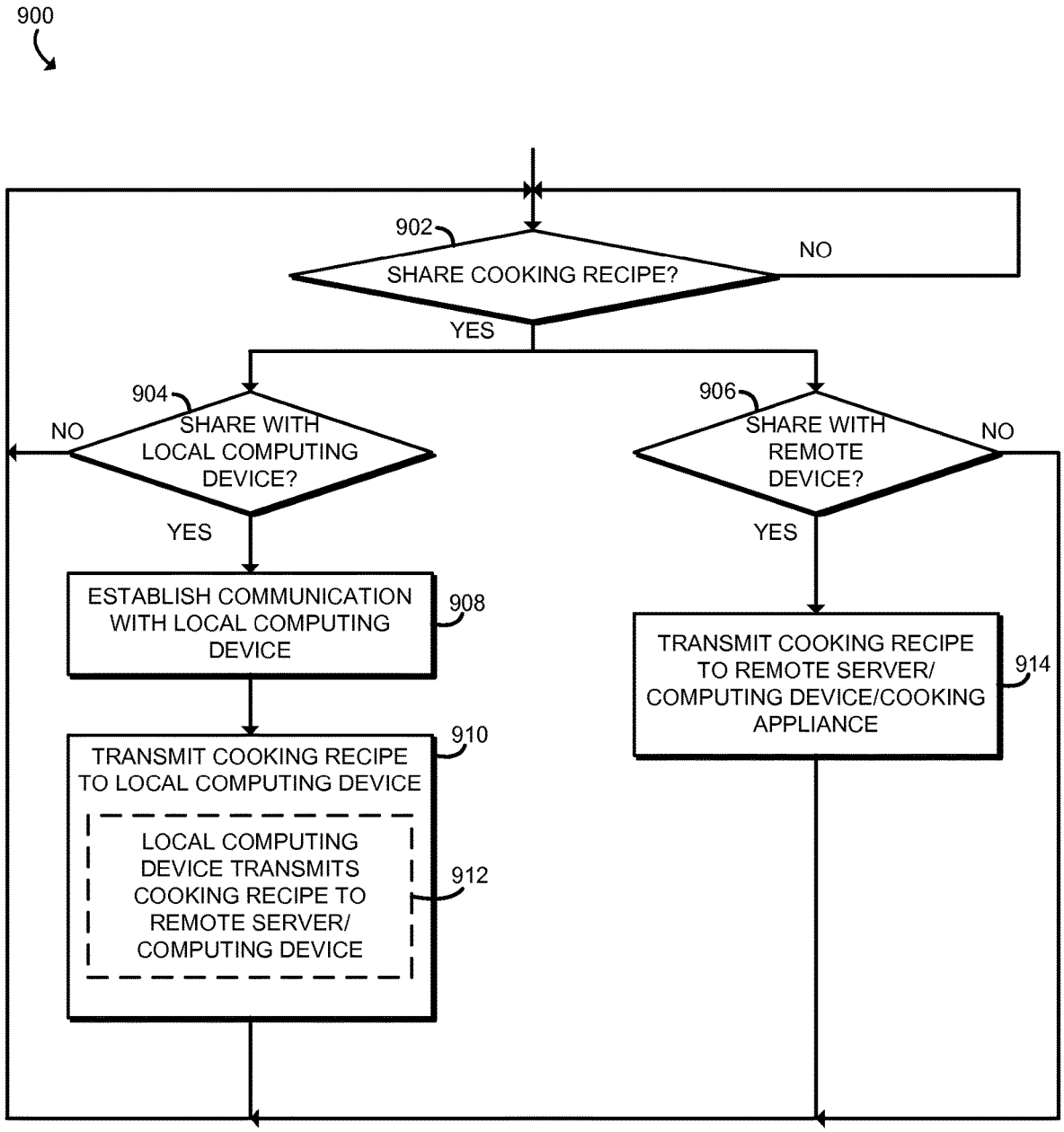
FIG. 9 is a simplified flow diagram of at least one embodiment of a method for sharing a cooking recipe that may be executed by the cooking appliance of FIGS. 2 and 3.

Referring now to FIG. 9, as discussed above, the user may operate the cooking apparatus 102 to share a newly generated cooking recipe as discussed above in regard to method 700 of FIGS. 7 and 8 or a cooking recipe previously stored in the data storage 226. To do so, the cooking apparatus 102 may execute a method 900 to share a cooking recipe. The method 900 begins with block 902 in which the cooking appliance 102 determines whether the user desires to share the cooking recipe. If so, the method 900 advances to block 904 and 906, which may be performed contemporaneously with each other. In block 904, the cooking apparatus determines whether the user desires to share with a local computing device, such as the user's mobile computing device 130. If so, the method 900 advances to block 908 in which the cooking appliance 102 established a communication with the local computing device. As discussed above, any type of communication protocol may be used to establish the communication link with the mobile computing device 130 or other local computing device. Once established, the method 900 advances to block 910 in which the cooking appliance 102 transmits the cooking recipe to the local computing device. In turn, the user may operate the local computing device to transmit the cooking recipe to other devices, such as the remote computing devices 110. The method 900 subsequently loops back to block 902 in which the cooking appliance 102 determines whether the user desires to share another cooking recipe.

Referring back to block 906, the cooking appliance 102 determines whether the user desires to share the cooking recipe with a remote computing device 110. If so, the method 900 advances to block 914 in which the cooking appliance 102 transmits the cooking recipe to one of the remote computing devices 110 via the network 120. The method 900 subsequently loops back to block 902 in which the cooking appliance 102 determines whether the user desires to share another cooking recipe. In this way, a user of the cooking appliance 102 may generate new recipes, acquire other recipes, and share or distribute new and acquired cooking recipes to friends and others.

Figure 10:
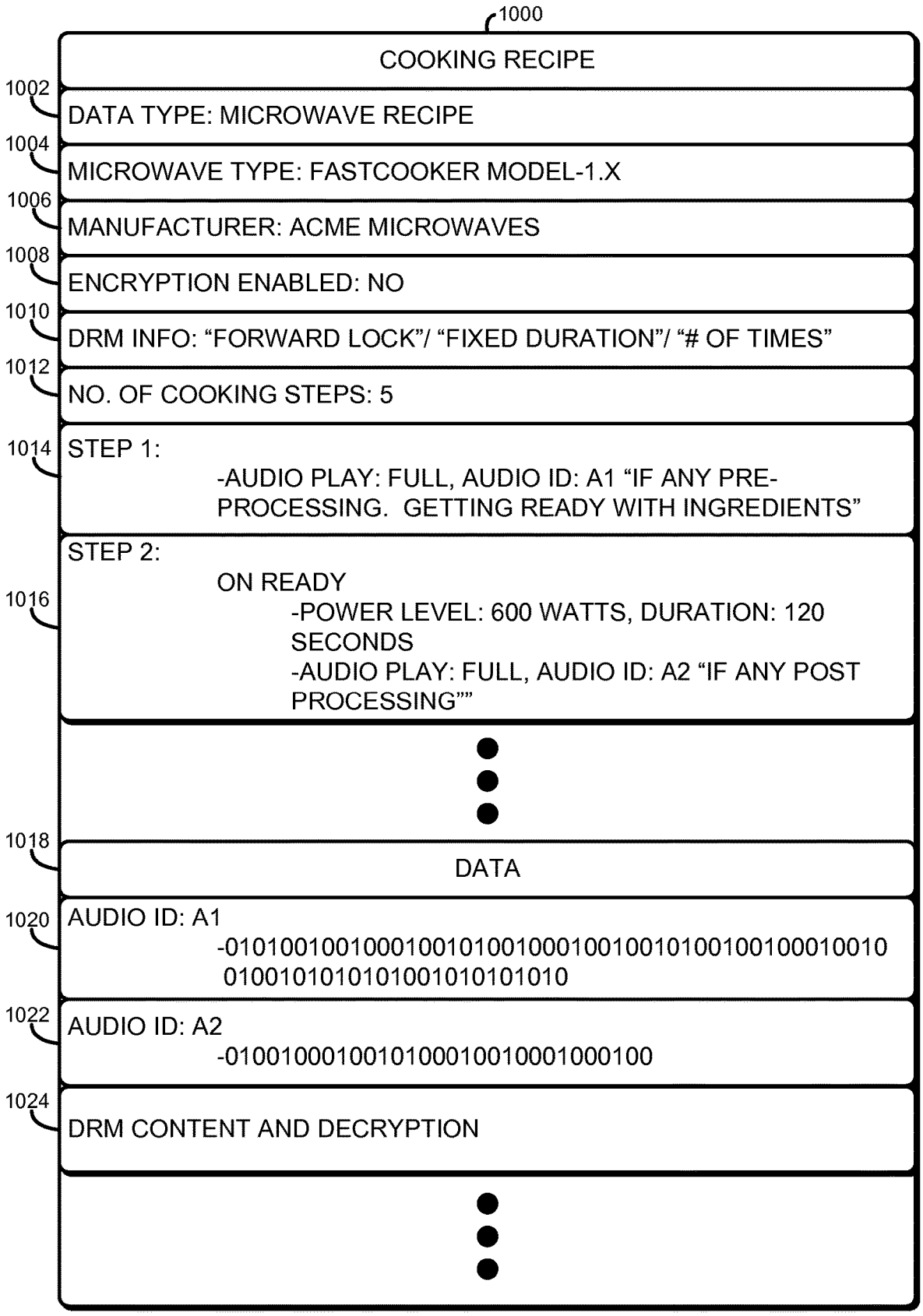
FIG. 10 is a simplified illustration of at least one embodiment of a cooking recipe executable by the cooking appliance of FIGS. 2 and 3.

Referring now to FIG. 10, an illustrative embodiment of a cooking recipe 1000 is shown. As discussed above, the cooking recipes may be embodied as any type of data and have any suitable format. In the illustrative embodiment, for example, the cooking recipe 1000 includes a data type field 1002 that defines the type of data provided ("Microwave Recipe"), an appliance type field 1004 that defines the type of cooking appliance ("Fastcooker Model-1.x), a manufacturer field 1006 that defines the manufacturer of the cooking appliance ("Acme Microwaves"), an encryption enabled field 1008 ("No"), a DRM info field 1010 ("Forward. Lock, Fixed Duration, # of times"), a number of cooking steps field 1012 ("5"), and step fields 1014 and 1016 that define the actions or operations to be performed by the cooking apparatus in each cooking step. Additionally, cooking recipe 1000 includes the data field 1018-1022 which provide the data to be used during execution of the corresponding cooking steps 1014, 1016. As discussed above, the cooking recipe may be embodied as HyperText Markup Language (HTML), Extensible Markup Language (XML), direct binary instructions, and/or other data formats.

EXAMPLES

Illustrative examples of the technologies disclosed herein are provided below. An embodiment of the technologies may include any one or more, and any combination of, the examples described below.

Example 1 includes a cooking appliance for performing a cooking recipe, the cooking appliance comprising a communication module to wirelessly receive the cooking recipe from a separate computing device, wherein the cooking recipe defines one or more cooking steps and each cooking step comprises executable instructions that are executable by the cooking appliance to cause the cooking appliance to perform the associated cooking step; and a cooking control module to execute the executable instructions of each cooking step to perform the cooking recipe.

Example 2 includes the subject matter of Example 1, and wherein the communication module is to establish a communication link with a remote computing device over a network; and receive the cooking recipe from the remote computing device via the network.

Example 3 includes the subject matter of any of Examples 1 and 2, and wherein the communication module is to establish a communication link with a mobile computing device of a user; and receive the cooking recipe from the mobile computing device via the communication link.

Example 4 includes the subject matter of any of Examples 1-3, and wherein the executable instructions of at least one cooking step define a reference power setting for the cooking appliance for the at least one cooking step, and wherein to execute the executable instructions comprises to adjust a power setting of the cooking appliance to the reference power setting.

Example 5 includes the subject matter of any of Examples 1-4, and wherein the executable instructions of at least one cooking step define a reference cooking time for the cooking appliance for the at least one cooking step, and wherein to execute the executable instructions comprises to adjust a cooking time setting of the cooking appliance to the reference cooking time.

Example 6 includes the subject matter of any of Examples 1-5, and wherein the executable instructions of at least one cooking step define a user instruction for the at least one cooking step, and further comprising a user interface module to provide the user instruction to a user of the cooking appliance while the at least one cooking step is performed by the cooking appliance.

Example 7 includes the subject matter of any of Examples 1-6, and further including an audio device, wherein the user interface module is to announce the user instruction to the user via the audio device.

Example 8 includes the subject matter of any of Examples 1-7, and further including a display, wherein the user interface module is to display the user instruction to the user via the display.

Example 9 includes the subject matter of any of Examples 1-8, and further including a user interface module to request feedback from a user of the cooking appliance and receive the feedback from the user, wherein the cooking control module is to adjust an operation of the cooking appliance based on the feedback.

Example 10 includes the subject matter of any of Examples 1-9, and wherein the executable instructions of at least one cooking step define an instruction to be executed by another appliance to complete the at least one cooking step, and wherein the communication module is to establish a communication link with the another appliance and transmit the instruction to the another appliance to complete the at least one cooking step.

Example 11 includes the subject matter of any of Examples 1-10, and wherein the executable instructions of at least one cooking step define a user instruction for preparation of a subsequent cooking step relative to the at least one cooking step, and further comprising a user interface module to provide the user instruction to a user of the cooking appliance while cooking control module performs the at least one cooking step.

Example 12 includes the subject matter of any of Examples 1-11, and further including a security module to determine whether the cooking recipe is encrypted and decrypt the cooking recipe in response to a determination that the cooking recipe is encrypted.

Example 13 includes the subject matter of any of Examples 1-12, and further including an instruction interpretation module to determine whether the cooking recipe is in a native recipe format executable by the cooking application and convert the cooking recipe to the native recipe format in response to a determination that the cooking recipe is not in the native recipe format.

Example 14 includes the subject matter of any of Examples 1-13, and wherein the cooking recipe is in an appliance manufacturer-independent recipe format, and wherein to convert the cooking recipe comprises to interpret the cooking recipe from the appliance manufacturer-independent recipe format to the native recipe format.

Example 15 includes the subject matter of any of Examples 1-14, and wherein the cooking recipe is in an appliance manufacturer-specific format different from the native recipe format and wherein to convert the cooking recipe comprises to covert the cooking recipe from the appliance manufacturer-specific recipe format to the native recipe format.

Example 16 includes the subject matter of any of Examples 1-15, and further including a security module to determine whether the cooking recipe includes a digital rights management security feature and enforce the digital rights management security feature on the cooking appliance in response to a determination that the cooking recipe includes the digital right management security feature.

Example 17 includes the subject matter of any of Examples 1-16, and wherein to enforce the digital right management security feature comprises to limit the number of performances of the cooking recipe by the cooking appliance.

Example 18 includes the subject matter of any of Examples 1-17, and wherein to enforce the digital right management security feature comprises restrict a distribution of the cooking recipe from the cooking appliance.

Example 19 includes the subject matter of any of Examples 1-18, and wherein the cooking recipe further includes preparatory instructions for the user, the preparatory instructions identifying at least one ingredient for the cooking recipe, and further comprising a user interface module to provide the preparatory instructions to a user of the cooking appliance prior to a performance, by the cooking control module, of a first cooking step of the at least one cooking step of the cooking recipe.

Example 20 includes a cooking appliance for generating a cooking recipe, the cooking appliance comprising a user interface module to prompt a user for cooking instructions associated with a first cooking step of the cooking recipe, wherein the cooking recipe comprises one or more cooking steps; an instruction recordation module to record an operation of the cooking appliance corresponding to the first cooking step and performed by the user on the cooking appliance; and a recipe generation module to generate the cooking recipe based on the recorded operation of the cooking appliance by the user, wherein the cooking recipe comprises executable instructions that are executable by the cooking appliance to cause the cooking appliance to perform the operation of the cooking appliance corresponding to the first cooking step.

Example 21 includes the subject matter of Example 20, and wherein to record the operation of the cooking appliance comprising to determine a reference power setting of the cooking appliance set by the user during the operation of the cooking appliance corresponding to the first cooking step, and wherein the executable instructions are executable by the cooking appliance to cause the cooking appliance to adjust a power setting of the cooking appliance to the reference power setting.

Example 22 includes the subject matter of any of Examples 20 and 21, and wherein to record the operation of the cooking appliance comprising to determine a reference cooking time of the cooking appliance set by the user during the operation of the cooking appliance corresponding to the first cooking step, and wherein the executable instructions executable by the cooking appliance to cause the cooking appliance to adjust a cooking time setting of the cooking appliance to the reference cooking time.

Example 23 includes the subject matter of any of Examples 20-22, and further including an audio sensor and an audio device; wherein the instruction recordation module is to record, by the audio sensor, verbal input for the first cooking step from the user prior to recordation of the operation of the cooking appliance corresponding to the first cooking step, and wherein to generate the cooking recipe comprises to generate executable instructions that are executable by the cooking appliance to cause the cooking appliance to announce, by the audio device, the verbal input prior to performance of the operation of the cooking appliance corresponding to the first cooking step.

Example 24 includes the subject matter of any of Examples 20-23, and further including an audio sensor and an audio device; wherein the instruction recordation module is to record, by the audio sensor, verbal commentary by the user while the operation of the cooking appliance corresponding to the first cooking step is recorded, and wherein to generate the cooking recipe comprises to generate executable instructions that are executable by the cooking appliance to cause the cooking appliance to announce, by an audio device of the cooking appliance, the verbal commentary while the operation of the cooking appliance corresponding to the first cooking step is performed.

Example 25 includes the subject matter of any of Examples 20-24, and further including an audio sensor and an audio device; wherein the instruction recordation module is to record, by the audio sensor, preparatory instructions by the user for the cooking instructions associated with the first cooking step, wherein the preparatory instructions include an ingredient list for the cooking recipe, and wherein to generate the cooking recipe comprises to generate executable instructions that are executable by the cooking appliance to cause the cooking appliance to announce, by the audio device, the preparatory instructions prior to performance of the operation of the cooking appliance corresponding to the first cooking step.

Example 26 includes the subject matter of any of Examples 20-25, and further including a security module to apply a digital rights management feature to the cooking recipe, wherein the digital rights management feature either (i) limits the number of performances of the cooking recipe by another cooking appliance or (ii) restricts the distribution of the cooking recipe the another cooking appliance.

Example 27 includes the subject matter of any of Examples 20-26, and further including an instruction interpretation module to convert the cooking recipe from a native recipe format to a manufacturer-independent recipe format.

Example 28 includes the subject matter of any of Examples 20-27, and further including a communication module to establish a communication link with a mobile computing device of the user and transmit the cooking recipe to the mobile computing device via the communication link.

Example 29 includes the subject matter of any of Examples 20-28, and further including a communication module to establish a communication link with a remote computing device over a network and transmit the cooking recipe to the remote computing device over the network.

Example 30 includes the subject matter of any of Examples 20-29, and wherein the user interface module is further to prompt the user for cooking instructions associated with a second cooking step of the cooking recipe, and the instruction recordation module is further to record an operation of the cooking appliance corresponding to the second cooking step and performed by the user on the cooking appliance, wherein to generate the cooking recipe comprises to generate executable instructions that are executable by the cooking appliance to cause the cooking appliance to sequentially perform the operation of the cooking appliance corresponding to the first cooking step and the second cooking step.

Example 31 includes a method for controlling a cooking appliance, the method comprising wirelessly receiving, by the cooking appliance, a cooking recipe from a separate computing device, wherein the cooking recipe defines one or more cooking steps and each cooking step comprises executable instructions that are executable by the cooking appliance to cause the cooking appliance to perform the associated cooking step; and executing, by the cooking appliance, the executable instructions of each cooking step to perform the cooking recipe.

Example 32 includes the subject matter of Example 31, and wherein receiving the cooking recipe comprises establishing a communication link with a remote computing device over a network; and receiving the cooking recipe from the remote computing device via the network.

Example 33 includes the subject matter of any of Examples 31 and 32, and wherein receiving the cooking recipe comprises establishing a communication link with a mobile computing device of a user; and receiving the cooking recipe from the mobile computing device via the communication link.

Example 34 includes the subject matter of any of Examples 31-33, and wherein the executable instructions of at least one cooking step define a reference power setting for the cooking appliance for the at least one cooking step, and wherein executing the executable instructions comprises adjusting, by the cooking appliance, a power setting of the cooking appliance to the reference power setting.

Example 35 includes the subject matter of any of Examples 31-34, and wherein the executable instructions of at least one cooking step define a reference cooking time for the cooking appliance for the at least one cooking step, and wherein executing the executable instructions comprises adjusting, by the cooking appliance, a cooking time setting of the cooking appliance to the reference cooking time.

Example 36 includes the subject matter of any of Examples 31-35, and wherein the executable instructions of at least one cooking step define a user instruction for the at least one cooking step, and wherein executing the executable instructions comprises providing, by the cooking appliance, the user instruction to a user of the cooking appliance while performing of the at least one cooking step by the cooking appliance.

Example 37 includes the subject matter of any of Examples 31-36, and wherein providing the user instruction comprises announcing, by an audio device of the cooking appliance, the user instruction to the user.

Example 38 includes the subject matter of any of Examples 31-37, and wherein providing the user instruction comprises displaying, by a display of the cooking appliance, the user instruction to the user.

Example 39 includes the subject matter of any of Examples 31-38, and wherein executing the executable instructions comprises requesting, by the cooking appliance, feedback from a user of the cooking appliance, receiving, by a user interface of the cooking appliance, the feedback from the user, and adjusting, by the cooking appliance, an operation of the cooking appliance based on the feedback.

Example 40 includes the subject matter of any of Examples 31-39, and wherein the executable instructions of at least one cooking step define an instruction to be executed by another appliance to complete the at least one cooking step, and wherein executing the executable instructions comprises establishing, by the cooking appliance, a communication link with the another appliance, and transmitting, by the cooking appliance, the instruction to the another appliance to complete the at least one cooking step.

Example 41 includes the subject matter of any of Examples 31-40, and wherein the executable instructions of at least one cooking step define a user instruction for preparation of a subsequent cooking step relative to the at least one cooking step, and wherein executing the executable instructions comprises providing, by the cooking appliance, the user instruction to a user of the cooking appliance during performance of the at least one cooking step by the cooking appliance.

Example 42 includes the subject matter of any of Examples 31-41, and further including determining, by the cooking appliance, whether the cooking recipe is encrypted, and decrypting, by the cooking appliance, the cooking recipe in response to a determination that the cooking recipe is encrypted.

Example 43 includes the subject matter of any of Examples 31-42, and further including determining, by the cooking appliance, whether the cooking recipe is in a native recipe format executable by the cooking application, and converting, by the cooking application, the cooking recipe to the native recipe format in response to a determination that the cooking recipe is not in the native recipe format.

Example 44 includes the subject matter of any of Examples 31-43, and wherein the cooking recipe is in an appliance manufacturer-independent recipe format and converting the cooking recipe comprises interpreting, by the cooking application, the cooking recipe from the appliance manufacturer-independent recipe format to the native recipe format.

Example 45 includes the subject matter of any of Examples 31-44, and wherein the cooking recipe is in an appliance manufacturer-specific format different from the native recipe format and converting the cooking recipe comprises converting, by the cooking application, the cooking recipe from the appliance manufacturer-specific recipe format to the native recipe format.

Example 46 includes the subject matter of any of Examples 31-45, and further including determining, by the cooking appliance, whether the cooking recipe includes a digital rights management security feature, and enforcing, by the cooking appliance, the digital rights management security feature in response to determining that the cooking recipe includes the digital right management security feature.

Example 47 includes the subject matter of any of Examples 31-46, and wherein enforcing the digital right management security feature comprises limiting the number of performances of the cooking recipe by the cooking appliance.

Example 48 includes the subject matter of any of Examples 31-47, and wherein enforcing the digital right management security feature comprises restricting, by the cooking appliance, a distribution of the cooking recipe from the cooking appliance.

Example 49 includes the subject matter of any of Examples 31-48, and wherein the cooking recipe further includes preparatory instructions for the user, the preparatory instructions identifying at least one ingredient for the cooking recipe, and further comprising providing, by the cooking appliance, the preparatory instructions to a user of the cooking appliance prior to performing a first cooking step of the at least one cooking step of the cooking recipe.

Example 50 includes a method for generating a cooking recipe, the method comprising prompting, by a cooking appliance, a user for cooking instructions associated with a first cooking step of the cooking recipe, wherein the cooking recipe comprises one or more cooking steps; recording, by the cooking appliance, an operation of the cooking appliance corresponding to the first cooking step and performed by the user on the cooking appliance; and generating, by the cooking appliance, the cooking recipe based on the recorded operation of the cooking appliance by the user, wherein generating the cooking recipe comprises generating executable instructions that are executable by the cooking appliance to cause the cooking appliance to perform the operation of the cooking appliance corresponding to the first cooking step.

Example 51 includes the subject matter of Example 50, and wherein recording the operation of the cooking appliance comprising determining a reference power setting of the cooking appliance set by the user during the operation of the cooking appliance corresponding to the first cooking step, and wherein generating the cooking recipe comprises generating executable instructions that are executable by the cooking appliance to cause the cooking appliance to adjust a power setting of the cooking appliance to the reference power setting Example 52 includes the subject matter of any of Examples 50 and 51, and wherein recording the operation of the cooking appliance comprising determining a reference cooking time of the cooking appliance set by the user during the operation of the cooking appliance corresponding to the first cooking step, and wherein generating the cooking recipe comprises generating executable instructions that are executable by the cooking appliance to cause the cooking appliance to adjust a cooking time setting of the cooking appliance to the reference cooking time.

Example 53 includes the subject matter of any of Examples 50-52, and further including recording, by an audio sensor of the cooking appliance, verbal input for the first cooking step from the user prior to recording the operation of the cooking appliance corresponding to the first cooking step, and wherein generating the executable instructions comprises generating, by the cooking appliance, executable instructions that are executable by the cooking appliance to cause the cooking appliance to announce, by an audio device of the cooking appliance, the verbal input prior to performing the operation of the cooking appliance corresponding to the first cooking step.

Example 54 includes the subject matter of any of Examples 50-53, and further including recording, by an audio sensor of the cooking appliance, verbal commentary by the user while recording of the operation of the cooking appliance corresponding to the first cooking step, and wherein generating the executable instructions comprises generating, by the cooking appliance, executable instructions that are executable by the cooking appliance to cause the cooking appliance to announce, by an audio device of the cooking appliance, the verbal commentary while performing the operation of the cooking appliance corresponding to the first cooking step.

Example 55 includes the subject matter of any of Examples 50-54, and further including recording preparatory instructions by the user prior to prompting the user for the cooking instructions associated with the first cooking step, wherein the preparatory instructions include an ingredient list for the cooking recipe, and wherein generating the executable instructions comprises generating, by the cooking appliance, executable instructions that are executable by the cooking appliance to cause the cooking appliance to announce, by an audio device of the cooking appliance, the preparatory instructions prior to performing the operation of the cooking appliance corresponding to the first cooking step.

Example 56 includes the subject matter of any of Examples 50-55, and further including applying a digital rights management feature to the cooking recipe, wherein the digital rights management feature either (i) limits the number of performances of the cooking recipe by another cooking appliance or (ii) restricts the distribution of the cooking recipe the another cooking appliance.

Example 57 includes the subject matter of any of Examples 50-56, and further including converting the cooking recipe from a native recipe format to a manufacturer-independent recipe format.

Example 58 includes the subject matter of any of Examples 50-57, and further including establishing a communication link with a mobile computing device of the user; and transmitting the cooking recipe to the mobile computing device via the communication link.

Example 59 includes the subject matter of any of Examples 50-58, and further including establishing a communication link with a remote computing device over a network; and transmitting the cooking recipe to the remote computing device over the network.

Example 60 includes the subject matter of any of Examples 50-59, and further including prompting, by the cooking appliance, the user for cooking instructions associated with a second cooking step of the cooking recipe; and recording, by the cooking appliance, an operation of the cooking appliance corresponding to the second cooking step and performed by the user on the cooking appliance; wherein generating the cooking recipe comprises generating executable instructions that are executable by the cooking appliance to cause the cooking appliance to sequentially perform the operation of the cooking appliance corresponding to the first cooking step and the second cooking step.

Example 61 includes one or more machine-readable storage media comprising a plurality of instructions stored thereon that, when executed, cause a cooking appliance to perform the method of any of Examples 31-60.

Example 62 includes a cooking appliance for performing a cooking recipe, the cooking appliance comprising means for wirelessly receiving a cooking recipe from a separate computing device, wherein the cooking recipe defines one or more cooking steps and each cooking step comprises executable instructions that are executable by the cooking appliance to cause the cooking appliance to perform the associated cooking step; and means for executing the executable instructions of each cooking step to perform the cooking recipe.

Example 63 includes the subject matter of Example 62, and wherein the means for receiving the cooking recipe comprises means for establishing a communication link with a remote computing device over a network; and means for receiving the cooking recipe from the remote computing device via the network.

Example 64 includes the subject matter of any of Examples 62 and 63, and wherein the means for receiving the cooking recipe comprises means for establishing a communication link with a mobile computing device of a user; and means for receiving the cooking recipe from the mobile computing device via the communication link.

Example 65 includes the subject matter of any of Examples 62-64, and wherein the executable instructions of at least one cooking step define a reference power setting for the cooking appliance for the at least one cooking step, and wherein the means for executing the executable instructions comprises means for adjusting a power setting of the cooking appliance to the reference power setting.

Example 66 includes the subject matter of any of Examples 62-65, and wherein the executable instructions of at least one cooking step define a reference cooking time for the cooking appliance for the at least one cooking step, and wherein the means for executing the executable instructions comprises means for adjusting a cooking time setting of the cooking appliance to the reference cooking time.

Example 67 includes the subject matter of any of Examples 62-66, and wherein the executable instructions of at least one cooking step define a user instruction for the at least one cooking step, and wherein the means for executing the executable instructions comprises means for providing the user instruction to a user of the cooking appliance while performing of the at least one cooking step by the cooking appliance.

Example 68 includes the subject matter of any of Examples 62-67, and wherein the means for providing the user instruction comprises means for announcing the user instruction to the user.

Example 69 includes the subject matter of any of Examples 62-68, and wherein the providing the user instruction comprises means for displaying the user instruction to the user.

Example 70 includes the subject matter of any of Examples 62-69, and wherein the means for executing the executable instructions comprises means for requesting feedback from a user of the cooking appliance, means for receiving the feedback from the user, and means for adjusting an operation of the cooking appliance based on the feedback.

Example 71 includes the subject matter of any of Examples 62-70, and wherein the executable instructions of at least one cooking step define an instruction to be executed by another appliance to complete the at least one cooking step, and wherein the means for executing the executable instructions comprises means for establishing a communication link with the another appliance, and means for transmitting the instruction to the another appliance to complete the at least one cooking step.

Example 72 includes the subject matter of any of Examples 62-71, and wherein the executable instructions of at least one cooking step define a user instruction for preparation of a subsequent cooking step relative to the at least one cooking step, and wherein the means for executing the executable instructions comprises the means for providing the user instruction to a user of the cooking appliance during performance of the at least one cooking step by the cooking appliance.

Example 73 includes the subject matter of any of Examples 62-72, and further including means for determining whether the cooking recipe is encrypted, and means for decrypting the cooking recipe in response to a determination that the cooking recipe is encrypted.

Example 74 includes the subject matter of any of Examples 62-73, and further including means for determining whether the cooking recipe is in a native recipe format executable by the cooking application, and means for converting the cooking recipe to the native recipe format in response to a determination that the cooking recipe is not in the native recipe format.

Example 75 includes the subject matter of any of Examples 62-74, and wherein the cooking recipe is in an appliance manufacturer-independent recipe format and the means for converting the cooking recipe comprises means for interpreting the cooking recipe from the appliance manufacturer-independent recipe format to the native recipe format.

Example 76 includes the subject matter of any of Examples 62-75, and wherein the cooking recipe is in an appliance manufacturer-specific format different from the native recipe format and the means for converting the cooking recipe comprises means for converting the cooking recipe from the appliance manufacturer-specific recipe format to the native recipe format.

Example 77 includes the subject matter of any of Examples 62-76, and further including means for determining whether the cooking recipe includes a digital rights management security feature, and means for enforcing the digital rights management security feature in response to determining that the cooking recipe includes the digital right management security feature.

Example 78 includes the subject matter of any of Examples 62-77, and wherein the means for enforcing the digital right management security feature comprises means for limiting the number of performances of the cooking recipe by the cooking appliance.

Example 79 includes the subject matter of any of Examples 62-78, and wherein the means for enforcing the digital right management security feature comprises means for restricting a distribution of the cooking recipe from the cooking appliance.

Example 80 includes the subject matter of any of Examples 62-79, and wherein the cooking recipe further includes preparatory instructions for the user, the preparatory instructions identifying at least one ingredient for the cooking recipe, and further comprising means for providing the preparatory instructions to a user of the cooking appliance prior to performing a first cooking step of the at least one cooking step of the cooking recipe.

Example 81 includes a cooking appliance for performing a cooking recipe, the cooking appliance comprising means for prompting a user for cooking instructions associated with a first cooking step of the cooking recipe, wherein the cooking recipe comprises one or more cooking steps; means for recording an operation of the cooking appliance corresponding to the first cooking step and performed by the user on the cooking appliance; and means for generating the cooking recipe based on the recorded operation of the cooking appliance by the user, wherein the means for generating the cooking recipe comprises means for generating executable instructions that are executable by the cooking appliance to cause the cooking appliance to perform the operation of the cooking appliance corresponding to the first cooking step.

Example 82 includes the subject matter of Example 81, and wherein the means for recording the operation of the cooking appliance comprises means for determining a reference power setting of the cooking appliance set by the user during the operation of the cooking appliance corresponding to the first cooking step, and wherein the means for generating the cooking recipe comprises means for generating executable instructions that are executable by the cooking appliance to cause the cooking appliance to adjust a power setting of the cooking appliance to the reference power setting Example 83 includes the subject matter of any of Examples 81 and 82, and wherein the means for recording the operation of the cooking appliance comprising means for determining a reference cooking time of the cooking appliance set by the user during the operation of the cooking appliance corresponding to the first cooking step, and wherein the means for generating the cooking recipe comprises means for generating executable instructions that are executable by the cooking appliance to cause the cooking appliance to adjust a cooking time setting of the cooking appliance to the reference cooking time.

Example 84 includes the subject matter of any of Examples 81-83, and further including means for recording verbal input for the first cooking step from the user prior to recording the operation of the cooking appliance corresponding to the first cooking step, and wherein the means for generating the executable instructions comprises means for generating executable instructions that are executable by the cooking appliance to cause the cooking appliance to announce, by an audio device of the cooking appliance, the verbal input prior to performing the operation of the cooking appliance corresponding to the first cooking step.

Example 85 includes the subject matter of any of Examples 81-84, and further including means for recording verbal commentary by the user while recording of the operation of the cooking appliance corresponding to the first cooking step, and wherein the means for generating the executable instructions comprises means for generating executable instructions that are executable by the cooking appliance to cause the cooking appliance to announce, by an audio device of the cooking appliance, the verbal commentary while performing the operation of the cooking appliance corresponding to the first cooking step.

Example 86 includes the subject matter of any of Examples 81-85, and further including means for recording preparatory instructions by the user prior to prompting the user for the cooking instructions associated with the first cooking step, wherein the preparatory instructions include an ingredient list for the cooking recipe, and wherein the means for generating the executable instructions comprises means for generating executable instructions that are executable by the cooking appliance to cause the cooking appliance to announce, by an audio device of the cooking appliance, the preparatory instructions prior to performing the operation of the cooking appliance corresponding to the first cooking step.

Example 87 includes the subject matter of any of Examples 81-86, and further including means for applying a digital rights management feature to the cooking recipe, wherein the digital rights management feature either (i) limits the number of performances of the cooking recipe by another cooking appliance or (ii) restricts the distribution of the cooking recipe the another cooking appliance.

Example 88 includes the subject matter of any of Examples 81-87, and further including means for converting the cooking recipe from a native recipe format to a manufacturer-independent recipe format.

Example 89 includes the subject matter of any of Examples 81-88, and further including means for establishing a communication link with a mobile computing device of the user; and means for transmitting the cooking recipe to the mobile computing device via the communication link.

Example 90 includes the subject matter of any of Examples 81-89, and further including means for establishing a communication link with a remote computing device over a network; and means for transmitting the cooking recipe to the remote computing device over the network.

Example 91 includes the subject matter of any of Examples 81-90, and further including means for prompting the user for cooking instructions associated with a second cooking step of the cooking recipe; and means for recording an operation of the cooking appliance corresponding to the second cooking step and performed by the user on the cooking appliance; wherein the means for generating the cooking recipe comprises means for generating executable instructions that are executable by the cooking appliance to cause the cooking appliance to sequentially perform the operation of the cooking appliance corresponding to the first cooking step and the second cooking step.

What is claimed is:

1. A first cooking appliance to cook food, the first cooking appliance comprising:
- a display;
- communication circuitry;
- instructions; and
- processor circuitry to execute the instructions to:
  - access a cooking recipe;
  - cause the display to present a preparatory instruction;
  - cause the first cooking appliance to execute a first cooking activity of the cooking recipe; and
  - request the communication circuitry to transmit an instruction to initiate a second cooking activity at a second cooking appliance, the second cooking appliance different from the first cooking appliance.

2. The first cooking appliance of claim 1, further including memory including a plurality of cooking recipes, the processor circuitry to access the cooking recipe from the memory.

3. The first cooking appliance of claim 2, wherein the display is a touchscreen, the processor circuitry to access the cooking recipe in response to a user input on the touchscreen.

4. The first cooking appliance of claim 1, wherein the communication circuitry is to wirelessly receive the cooking recipe from an electronic device over a network.

5. The first cooking appliance of claim 4, wherein the electronic device is a third cooking appliance.

6. The first cooking appliance of claim 1, wherein the preparatory instruction includes a list of ingredients associated with the cooking recipe.

7. The first cooking appliance of claim 1, wherein the preparatory instruction is a first preparatory instruction, the processor circuitry to, after identifying the second cooking activity, cause the display to present a second preparatory instruction, the second preparatory instruction associated with the second cooking activity.

8. The first cooking appliance of claim 1, wherein the first cooking appliance is a mixer, and the second cooking appliance is an oven.

9. The first cooking appliance of claim 1, wherein the processor circuitry is to at least one of adjust a power setting of the first cooking appliance to a reference power setting or adjust a cooking time setting of the first cooking appliance to a reference cooking time.

10. The first cooking appliance of claim 1, wherein the processor circuitry is to:

determine whether the cooking recipe is in a native recipe format executable by the first cooking appliance; and convert the cooking recipe to the native recipe format in response to a determination that the cooking recipe is not in the native recipe format.

11. The first cooking appliance of claim 10, further including memory, the memory including at least one of a language dictionary or a conversion chart, the processor circuitry to convert the cooking recipe to the native recipe format using at least one of the language dictionary or the conversion chart.

12. A non-transitory machine-readable storage medium comprising instructions that, when executed, cause one or more processors of a first cooking appliance to at least:

access a cooking recipe;

cause a display of the first cooking appliance to present a preparatory instruction;

cause the first cooking appliance to execute a first cooking activity of the cooking recipe; and cause communication circuitry of the first cooking appliance to transmit a second cooking activity of the cooking recipe to a second cooking appliance, the second cooking appliance different from the first cooking appliance.

13. The non-transitory machine-readable storage medium of claim 12, wherein the instructions, when executed, cause the one or more processors to access the cooking recipe from memory including a plurality of cooking recipes.

14. The non-transitory machine-readable storage medium of claim 13, wherein the display is a touchscreen, and wherein the instructions, when executed, cause the one or more processors to access the cooking recipe from the memory in response to a user input on the touchscreen.

15. The non-transitory machine-readable storage medium of claim 12, wherein the cooking recipe is wirelessly received by the communication circuitry from a third cooking appliance.

16. The non-transitory machine-readable storage medium of claim 12, wherein the preparatory instruction includes a list of ingredients associated with the cooking recipe.

17. The non-transitory machine-readable storage medium of claim 12, wherein the preparatory instruction is a first preparatory instruction, and wherein the instructions, when executed, cause the one or more processors to, after identifying the second cooking activity, cause the display to present a second preparatory instruction, the second preparatory instruction associated with the second cooking activity.

18. The non-transitory machine-readable storage medium of claim 12, wherein the instructions, when executed, cause the one or more processors to at least one of adjust a power setting of the first cooking appliance to a reference power setting or adjust a cooking time setting of the first cooking appliance to a reference cooking time.

19. The non-transitory machine-readable storage medium of claim 12, wherein the instructions, when executed, cause the one or more processors to:

determine whether the cooking recipe is in a native recipe format executable by the first cooking appliance; and convert the cooking recipe to the native recipe format in response to a determination that the cooking recipe is not in the native recipe format.

20. The non-transitory machine-readable storage medium of claim 19, wherein the instructions, when executed, cause the one or more processors to convert the cooking recipe to the native recipe format using at least one of a language dictionary or a conversion chart.

* * * * *